US005649359A

United States Patent [19]

Murakami et al.

[11] Patent Number: 5,649,359

[45] Date of Patent: Jul. 22, 1997

[54] INK JET HEAD MANUFACTURING METHOD USING ION MACHINING AND INK JET HEAD MANUFACTURED THEREBY

[75] Inventors: Keiichi Murakami; Tadayoshi Inamoto, both of Hachiohji; Hirokazu Komuro, Yokohama; Hideaki Mashio, Kawasaki; Toshio Suzuki, Inagi, all of Japan

[73] Assignee: Canon Kabushiki Kaisha, Tokyo, Japan

[21] Appl. No.: 531,903

[22] Filed: Sep. 21, 1995

Related U.S. Application Data

[63] Continuation of Ser. No. 113,803, Aug. 31, 1993, abandoned.

[30] Foreign Application Priority Data

| | | | |
|---|---|---|---|
| Aug. 31, 1992 | [JP] | Japan | 4-232054 |
| Aug. 31, 1992 | [JP] | Japan | 4-232055 |
| Aug. 31, 1992 | [JP] | Japan | 4-232056 |
| Aug. 31, 1992 | [JP] | Japan | 4-232057 |

[51] Int. Cl.[6] ..... B41J 2/16

[52] U.S. Cl. ..... 29/890.1

[58] Field of Search ..... 29/890.1, 25.35

[56] References Cited

U.S. PATENT DOCUMENTS

| | | | |
|---|---|---|---|
| 3,921,916 | 11/1975 | Bassous | 236/601 |
| 4,047,184 | 9/1977 | Bassous et al. | 156/661 |
| 4,450,455 | 5/1984 | Sugitani et al. | 346/140 R |
| 4,509,063 | 4/1985 | Sugitani et al. | 346/140 R |
| 4,521,787 | 6/1985 | Yokota et al. | 346/140 R |
| 4,568,953 | 2/1986 | Aoki et al. | 346/140 R |
| 4,583,690 | 4/1986 | You | 239/690 |
| 4,609,427 | 9/1986 | Inamoto et al. | 156/633 |
| 4,666,823 | 5/1987 | Yokota et al. | 430/320 |
| 4,698,645 | 10/1987 | Inamoto | 346/140 R |
| 4,701,766 | 10/1987 | Sugitani et al. | 346/1.1 |
| 4,860,033 | 8/1989 | Shiozaki et al. | 346/140 R |
| 4,881,318 | 11/1989 | Komuro et al. | 29/827 |
| 5,059,973 | 10/1991 | Watanabe | 347/47 |
| 5,073,785 | 12/1991 | Jansen et al. | 346/1.1 |
| 5,126,768 | 6/1992 | Nozawa et al. | 346/140 R |
| 5,148,193 | 9/1992 | Inamoto et al. | 346/1.1 |

FOREIGN PATENT DOCUMENTS

| | | |
|---|---|---|
| 0529078A1 | 3/1992 | European Pat. Off. . |
| 0479493A1 | 4/1992 | European Pat. Off. . |
| 0495649A1 | 7/1992 | European Pat. Off. . |

*Primary Examiner*—Valerie Lund

*Attorney, Agent, or Firm*—Fitzpatrick, Cella, Harper & Scinto

[57] ABSTRACT

An ink jet recording head manufacturing method for manufacturing ink jet recording head having an ink passage, wherein a droplet of ink is ejected through the passage from an ink ejection outlet at an end of a passage onto a recording material. Ions are injected into a surface having the ink ejection outlet to change a surface property of the surface.

14 Claims, 12 Drawing Sheets

(A)

(B)

INK JET HEAD MANUFACTURING METHOD USING ION MACHINING AND INK JET HEAD MANUFACTURED THEREBY

This application is a continuation of application Ser. No. 8/113,803 filed Aug. 31, 1993, now abandoned.

FIELD OF THE INVENTION AND RELATED ART

The present invention relates to an ink jet head and a manufacturing method of the ink jet head, the ink jet head ejecting droplets of ink onto a recording of material to effect recording images, characters or the like, more particularly to an ink jet head manufacturing method using an ion machining method or ion injecting method, and an ink jet head manufactured thereby.

It is desirable for an ink jet printer to be able to print fine and clear images, characters or the like. Therefore, a microlithographic technique has been used to manufacture a great number of fine ejection outlets at high density so as to permit high speed and high density printing.

FIG. 1 is a perspective view of an example of an ink Jet recording head having been manufactured through such a method. It comprises a base plate 1 having a silicon wafer plate or the like, a heat accumulation layer, a heater, an electrode and a protection layer thereon. It also comprises an orifice plate having ejection outlets of 50 microns diameter manufactured through electrocasting or laser machining. It further comprises ejection outlet 3 and ink supply pipe 4. However, in the ink jet recording system, further high density ejection outlets are required, more particularly the ejection outlets having a diameter of as small as 20 microns diameter. On the other hand, in recording head having the conventional ejection outlet density, the accuracy of the ejection outlets are desired to improve the printing performance to meet the demands in the graphic printing field.

FIG. 2 is a cross-sectional view of the ink jet recording head of FIG. 1 adjacent the ejection outlets. There are shown two examples in which ink droplets 8 are ejected through the ink passages. In FIG. 2(A), the ink droplet is ejected in a proper direction wherein the ejection side surface 9 is not wetted by the ink; whereas in FIG. 2(B), a part of the ejection side surface 9 is wetted by the ink before the ink ejection, and therefore, the ink droplet is ejected in an incorrect direction.

The wetting of the ejection side surface 9 occurs in the following cases. First, the ink spreads upon ink ejection. In the case of an ink jet recording head carried on a carriage, the mechanical vibration or the like during movement in the scanning printing or upon the reversing of the carriage, the ink inside and adjacent to the nozzle flows out to wet the ejection side surface.

When the ink wetting the ejection side surface 9 returns into the passage through the ejection outlet, or when the periphery of the ejection outlet is uniformly wetted, the ink-droplet ejecting direction is correct, as shown in FIG. 2(A), and therefore, the ink ejection and therefore the recording operation are stabilized.

However, in the prior art ink jet recording head, the ejection side surface 9 is wetted non-uniformly, or the ink remains non-uniformly once it wets the ejection side surface 9, with the result of unstable ejection, as shown in FIG. 2(B).

There is a significant interrelationship between the wetting of the ejection outlet side surface and the surface condition thereof. If the surface condition of the ejection side surface is not proper, the instable ejection, improper recording and therefore deteriorated recording quality, result.

This problems arise not only in the ink jet recording head shown in FIG. 1 but also in another type of ink jet recording head. In the case where the ink ejection outlets are closely disposed near each other as in the case of FIG. 1, the peripheral wetting of the ejection outlets may result in wetting which connects the adjacent ejection outlets with the result of more significant influence. As a result, the recorded character may be deformed, or the recorded image may be disturbed, thus remarkably deteriorating the print quality or image quality. Therefore, it is necessary to control strictly the ejection side surface.

In order to accomplish this, it would be considered that the ejection side surface is treated to have a water repelling nature, thus preventing the wetting thereof. Many proposals have been made as to the provision of water repelling material on the ink ejection side surface.

For example, water repelling fluorine resin or the like; an organic polymer or the like having a water repelling property is applied by evaporation or sputtering. However, the coating thus produced does not have sufficient adhesion relative to the ejection side surface with the result of possible removal thereof from the ejection side surface. Therefore, durability is a problem.

As for the demand for recent ink jet recording apparatus, there is a larger choice of recording materials, in other words, printing is possible on any kind of sheet. However, some sheets readily produce paper dust or the like, which may be deposited on the ejection side surface of the ink jet recording head. If this occurs, the ink ejected is influenced by the paper dust or the like with the result of deteriorated printing. Therefore, it is desired that the paper dust or the like is removed. At present, a blade is periodically used to scrape the ejection side surface to remove the paper dust or the like containing the ink droplets. The water repelling material adhered through the above-described conventional process does not have sufficient adhesion, and therefore, the choice of usable materials for the blade is limited. Therefore, it is desirable to reduce the limitation for the blade material from the standpoint of increasing the design latitude and low cost. It is desirable, therefore, that a durable water-repelling nature is provided on the ejection side surface.

The paper dust is more readily deposited on the ejection side surface when the ejection side surface has an electrically insulative nature. This is because the ejection side surface is easily charged electrically, onto which the paper dust is electrostatically attracted. Therefore, the ejection side surface is preferably of electroconductive nature.

In an ink jet recording head, the ink liquid ejection responsivity, ejection efficiency or the ejection stability or the like are deteriorated in some cases if a high speed or long term recording is carried out. The reason for this is production of bubbles from the ink in a liquid chamber of the recording head. If they are produced, the motion of the ink is obstructed adjacent fine ejection outlets. In addition, the ink ejecting force provided by ejection energy generating means such as a piezoelectric element or heat generating resistor or the like is absorbed by the bubbles with the result of degraded responsivity. Therefore, the liquid droplets are not stably ejected in response to signals. In a recording head using piezoelectric elements, the abrupt pressure change in the ink by the piezoelectric element may produce cavitation in the ink.

In the case of the recording head in which the ink is ejected by thermal energy, the change of state of the ink (production of a bubble by thermal energy) is used to provide the ejection force of the ink. Therefore, unnecessary bubbles tend to be produced, which significantly influence the ejection responsivity, ejection efficiency and ejection stability or the like.

The unnecessary bubbles, once produce, is unlikely to disappear in the liquid chamber, and the production of unnecessary bubbles is promoted by the dissolved gasses in the ink.

Various methods have been proposed to remove the unnecessary bubbles in the ink. As a method for reducing the content of the dissolved gasses, a hermetically sealed container is used, or an oxygen absorbing material is added in the ink. In another method, a passage for removing the bubbles is used which is in fluid communication with the liquid chamber, at an upper position of the liquid chamber of the recording head, by which the buoyancy of the bubbles is used to trap the bubbles in the upper passage.

However, these methods are not satisfactory, as the case may be. For example, even if the ink is contained in a container made of sealing material, the gasses (air) penetrate through the material for a long term to the extent of substantially saturation amount. Addition of the oxygen absorbing material in the ink may adverse influence the natures of the ink. In the case of the recording head in which the ink is ejected by thermal energy, an abrupt state change is advantageous from the standpoint of improving the responsivity and ejection efficiency or the like. To facilitate this, gasses may be deliberately dissolved in the ink. Therefore, the elimination of the dissolved gasses is not always preferable.

In the case of the provision of a passage for trapping the air bubbles at an upper position of a liquid chamber of the recording head, bubble motion is dependent solely on the bubble's buoyancy. Since the trapping passage is small the elimination of the bubble is small.

As for the method of eliminating unnecessary bubbles in the liquid chamber, Japanese Laid-Open Patent Application No. 12074/1980 proposes a mechanism for flowing the ink in the liquid chamber. In this method, large bubbles may be easily removed however, the significant cost is imposed on the mechanism to completely remove the fine bubbles, and the size of the apparatus is increased. For the purpose of providing uniform material around the ejection outlets, as well as a water repelling nature for the ejection side surface and the uniform shapes of the ejection outlets for the stabilization of the ink ejection in the correct direction, there is proposed an ink jet recording head having an orifice plate made of water repelling material. In this head, the back side of the ejection side surface also exhibits the water repelling nature with the result that easy stagnation of the bubbles is possible. If the unnecessary bubbles stagnate, the ejection state becomes unstable. Therefore, a proper recording state is not maintained, but the record quality is deteriorated.

The shape of the ejection outlet influences to the ink ejection property. In the prior art, the ejection outlet is formed by etching techniques. However, this method involves a problem in that a straight opening can not be formed, and as a result, the resultant ejection outlet is tapered. Therefore, it is difficult to accurately manufacture the fine ejection outlets. It would be possible to use a thin material in an attempt to improve the accuracy of the ejection outlet, but that would result in an impractical large reduction in the mechanical strength of the orifice plate.

In another method, laser machining is used. However, the shavings produced by the laser machining are deposited around the ejection outlets with the result of degraded print quality. This problem is even more remarkable in a high density ink jet recording head.

SUMMARY OF THE INVENTION

Accordingly, it is a principal object of the present invention to provide an ink jet recording head in which substantially constant volumes of droplets can be ejected in a predetermined direction in high speed recording, and the durability is high.

It is another object of the present invention to provide an ink jet recording head which can reject the ink stably with a large choice of recording materials.

It is a further object of the present invention to provide an ink jet recording head in which the surface treated for the water repelling property is provided with wear-resistance, thus permitting a larger choice of the blade material.

It is a further object of the present invention to provide an ink jet recording head in which stagnation of a bubble at a portion in contact with the ink, thus avoiding the reduction of the record quality, permits a stabilized and high speed recording.

It is a further object of the present invention to provide a method of forming ejection outlets with high precision and at high density.

According to an aspect of the present invention, in order to provide the ejection side surface with the water repelling property and electrically conductive property and high hardness, the ejection side surface of the ink jet recording head is improved through ion injection thereto.

According to another aspect of the present invention, at least a part of the ink, contacting area in the ink is subjected to ion injection to achieve a hydrophilic property.

The high density and high accuracy ejection outlets can be provided by the ion machining method.

According to a further aspect of the present invention, there is provided an ink jet recording head manufacturing method for manufacturing an ink jet recording head having an ink passage, wherein a droplet of ink is ejected through the passage from an ink ejection outlet at an end of a passage onto a recording material, the improvement comprising: ions are injected into a surface having the ink ejection outlet to change a surface property of the surface.

According to a further aspect of the present invention, there is provided an ink jet recording head comprising: an ink passage having an ink ejection energy generating element which causes a change in the state of ink in the passage; an ink ejection outlet, in communication with the ink passage, through which a droplet of the ink is ejected following the state change onto a recording material: a surface layer of an ink ejection side surface having the ejection outlet; wherein ions are injected into the surface layer after it is formed to change a surface property of the surface.

According to a further aspect of the present invention, there is provided an ink jet recording head comprising: an ink passage having an ink ejection energy generating element which causes a change in the state of ink in the passage; an orifice plate; an ink ejection outlet, in communication with the ink passage, through which a droplet of the ink is ejected following the state change onto a recording material; wherein the ejection outlet is formed by ion machining in the orifice plate.

According to a further aspect of the present invention, there is provided an ink jet recording head comprising: an ink passage having an ink ejection energy generating element which causes a change in the state of ink in the passage; an orifice plate; an ink ejection outlet, in communication with the ink passage, through which a droplet of the ink is ejected following the state change onto recording material; wherein the ejection outlet is formed by ion machining in the orifice plate, and ions are injected into the orifice plate to change a surface property of the surface According to a further aspect of the present invention, there is provided an ink jet recording head comprising: an ink passage having an ink ejection energy generating element in the passage; an ink ejection outlet, in communication with the ink passage, through which a droplet of the ink is ejected by actuation of the ink ejection energy generating element onto a recording material; an ink chamber in communication with the ink ejection outlet through the ink passage; wherein ions are injected into a part of an inside surface of the ink jet recording head which is in contact with the ink to provide the part with hydrophilic property.

According to a further aspect of the present invention, there are provided methods of manufacturing the ink jet recording heads according to the above-described aspects.

According to a further aspect of the present invention, ion beam is used for all of ejection outlet machining, ejection side surface improvement and inside surface improvement.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Above FIGS. 10, 11 and 12 illustrate the manufacturing steps.

DESCRIPTION OF THE PREFERRED EMBODIMENTS

The description will first be made of the ion machining method for machining the ejection outlets and an ion injecting method for improving a surface property of an ink ejection side surface and a part of the inside surfaces of the recording head.

Ion Machining

According to an aspect of the present invention, the ejection outlets are formed in an orifice plate by an ion machining method in which particular ion machining conditions are used in combination.

As for an ion machining apparatus, a high intensity converging ion beam apparatus (FIB) is used.

Figure 3:
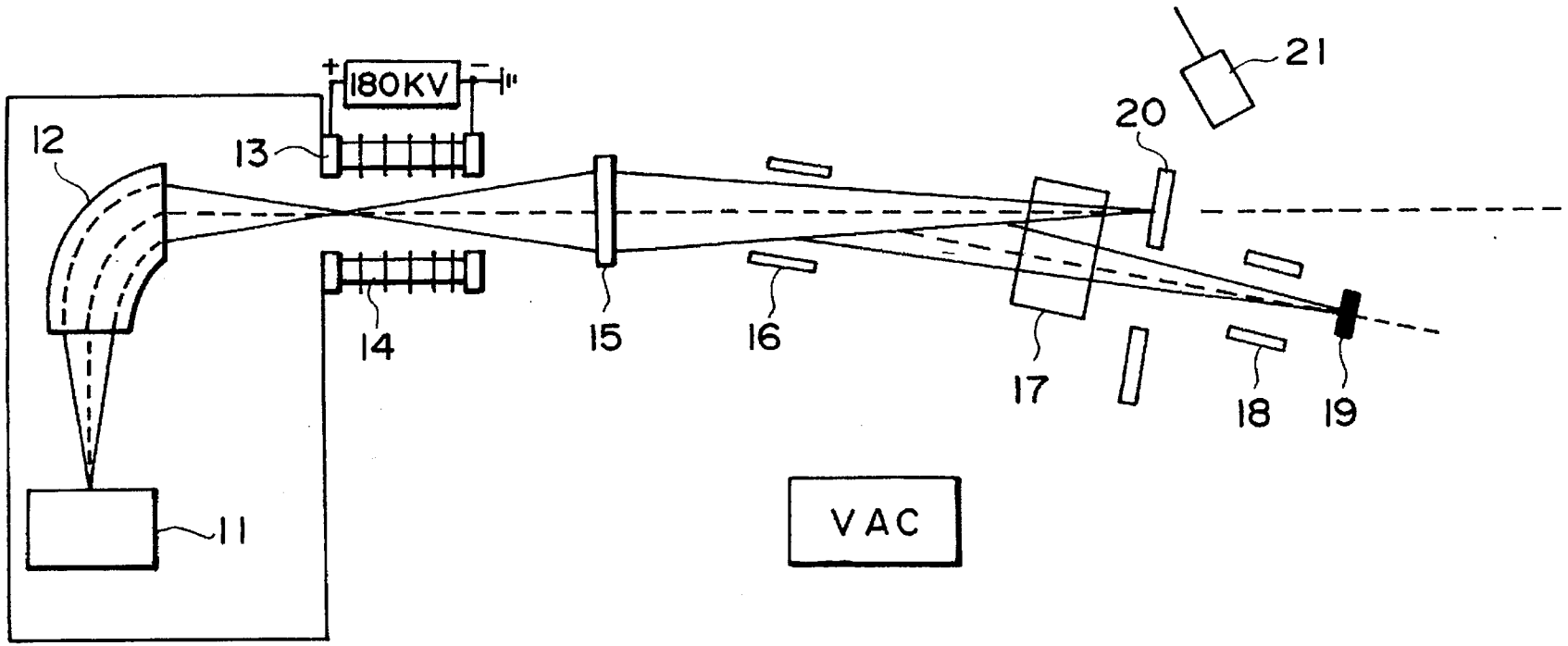
FIG. 3 is a schematic view of a converging ion beam apparatus.

Referring to FIG. 3, there is shown a basic structure of FIB. As shown in this Figure, the FIB comprises, in a vacuum, an ion source 11, a mass spectrograph 12, an objective lens 15, a beam scanning system constituted by elements 16, 17, 18 and 20, and a secondary electron detector 21. The secondary electron detector 21 functions to detect the secondary electrons emitted by FIB irradiation to permit observation and machining position detection of the material to be machined.

In order to use the FIB for formation of ink jet recording head, novel machining conditions are selected according to the present invention. These conditions will be described.

As for the machining ion source, high intensity liquid metal is used, examples of which include Ga, Al, Si-Au, Ge-Au or another low melting point metal, or alloy thereof. When the alloy is used, the vapor pressure and the melting point are substantially equivalent to those of the non-alloy metal.

As for the ions provided by the ion source, they can include $Ga^+$, $Al^+$, $Au^+$ and $Ge^+$ or the like.

The ion accelerating voltage is 100–300 keV, preferably 150–200 keV. The 300 keV limit is determined from the performance limit of the FIB, and if the accelerating voltage is larger than that, the substrate will be overheated. The 100 keV limit is determined from the machinability.

A larger ion beam diameter is preferable from the standpoint of larger beam current and therefore higher etching speed, but correspondingly, the accuracy decreases. Therefore, the beam diameter is determined on the basis of the required accuracy. Here, the ion beam diameter is 0.5–50 microns, preferably 1–5 microns. If it is smaller than 0.5 micron, a sufficient etching speed is not obtained and on the contrary if it is larger than 50 microns, machining of fine ejection outlets with the sufficient accuracy becomes difficult.

The ion current 100–10,000 pA, preferably 100–5,000 pA. If it is smaller than 10 pA, a sufficient etching speed is not obtained. If it is larger than 10,000 pA, the ion stability is deteriorated.

The material in which the ejection outlets are formed through the ion machining, may be any sort of structural member. Among metals, Ni or SUS is preferable. Among inorganic material, Si glass is preferable. Among resin materials, polysulfone or the like is preferable.

The present invention using the FIB is advantageous in:

(1) that the ion etching is possible without registration;

(2) that the linearity of the ion beam is so good that the cross-sectional shape of the machined part is perpendicular.

In an aspect of the present invention, the orifice plate has the ejection outlets formed by the ion machining or the orifice plate, before the ion machining process, is given the water repelling nature by ion injection process. In this invention, the order of formation of ejection outlets of ion machining process and the water repelling treatment by the ion injection, is not limited.

Ion Injection

In an aspect of the present invention, a surface layer is formed on the ejection side surface, and thereafter, the ions are implanted into the surface layer, thus providing the water repelling property. This is advantageous in that:

(1) It is made not necessary that the surface layer is of a water repelling material, and therefore, the material of the surface layer can be selected from various materials irrespective of the water repelling nature:

(2) Since the material may not exhibit the water repelling nature, the material may be selected from the material exhibiting high adhesion to the ejection side surface:

(3) Since the ions are implanted into the surface layer, the adhesion between the surface layer and the ejection side surface can be further improved:

(4) The surface property of the surface can be improved by the ion injection:

(5) The surface layer may be given electroconductivity by the ion injection, so that the paper dust or the like is prevented from being deposited on the ejection side surface: and (6) Since the ions are injected after formation of the surface layer, the smoothness and the water repelling nature of the ejection side surface is uniform, and therefore, proper ink ejection is possible, even if the ejection side surface is made of a plurality of materials.

According to an aspect of the present invention, the combination of the surface layer and the injected ions, the adhesion, surface hardness and the conductivity can be properly provided.

The material constituting the surface layer is selected from the material which is durable against the high temperature during the ion injection and which is securedly adhered to the ejection side surface after the ion injection. Particularly, the usable metals include Au, Ni, Cr, Ti, Al, Ta, W, V or the like. The usable inorganic materials include $SiO_2$, $Ta_2O_5$, $Ta_2n$, BN or the like. These materials or organic materials are preferable because they exhibit high adhesion property relative to an organic or inorganic compound of the ejection side surface, such as semiconductor (Si or the like), glass, ceramic material, oxide of semiconductor material, organic polymer or organic resin.

The preferable surface layer forming methods include the evaporation method, sputtering method, CVD method or other vacuum film forming method- Among them, the sputtering method is preferable from the standpoint of the adhesion property. The surface layer may be formed by painting or the spray method. In this case, if the heating operation is carried out after the painting, the adhesion is improved.

The film thickness of the surface layer is 0.05–5 microns, preferably 0.1–3 microns, because if it is larger than 5 microns, the remaining stress is large with the result of easy removal of the film, and if it is smaller than 0.05 micron, the desired nature of the film is not provided.

In this invention, the water repelling property is given by the ion injection into the surface layer thus formed.

The ion injection method will be described. In the ion injection method, ions accelerated to 10-several hundreds keV, are applied to the surface of a solid material to control the nature of the surface. This ion injection method is used for the purpose of formation of a diffused layer by impurity doping for a semiconductor device or for the purpose of adjustment of carrier density. In addition, in an attempt to improve the nature of metal (for example, hardness or wear resistance improvement in a drill), the investigations are carried out.

Figure 4:
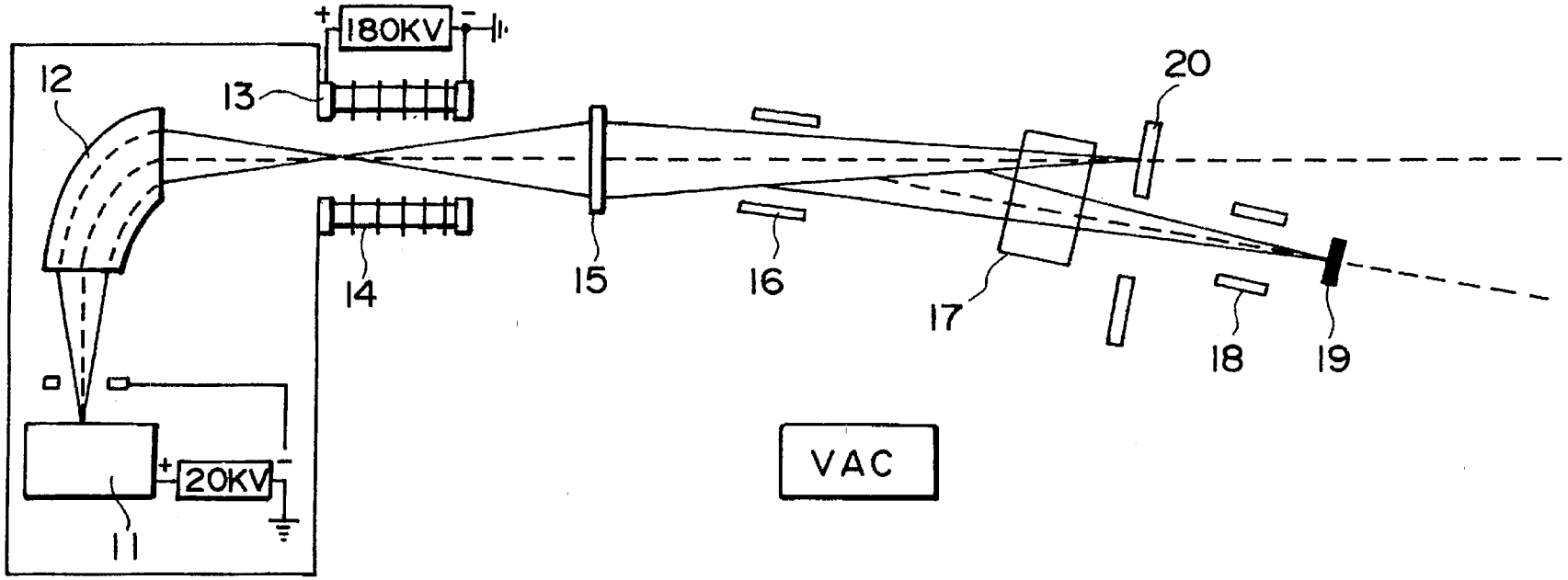
FIG. 4 is a schematic illustration of ion injector.

FIG. 4 shows a typical structure of an ion injector. The ions are produced in an ion source 11. The ions are extracted from plasma provided by DC or RF discharge in the gas of approx. $10^{-3}$ Torr. The extracted ion beam contains ionized atoms, molecular ions, residual gas ions and others, and therefore, only the required ions are extracted by means of mass spectrograph 12.

The spectrograph 12 is not necessarily required. In the case of improvement of the surface of the metal, it is hardly used. On the other hand, in the case of semiconductor device manufacturing, they are usually employed. The required ions selected by the mass spectrograph 12 are passed through a beam slit 13, an accelerator 14, a lens 15, a neutral beam trap, and a gate 16. Thereafter, the ion beam is scanningly deflected relative So X axis and Y axis by a Y scanner 17 or X scanner 18 to uniformly scan the substrate 19 such as a wafer. Designated by reference numeral 20 is a beam trap. In another ion injector, the material supporting table is rotated to effect the uniform injection.

Since the water repelling property treatment using the ion injection improves the nature of the surface, and therefore, the adhesion is satisfactory as compared with the method in which a coating layer is formed on the surface. In addition, since the injected ions can be selected, the hardness and electroconductivity as well as water repelling property can be provided. The ion source for giving the water repelling property is in the form of a gas under normal or reduced pressure. The usable ones include:

(1) Gasses containing at least C and F such as $CF_4$, $C_2F_6$, $CHF_3$ or the like:

(2) A combination of gas containing F and gas containing C, as represented by a combination of F gas and methane gas:

(3) F gas only, when the material in which the ions are injected contains C.

The usable ions extracted from the ion source include:

(1) Ions containing C and F, as represented by $CF_3^+$, $C_2F_6^+$, $C_2F_3^+$ or the like:

(2) A combination of $F^+$ and $C^+$: and (3) $F^+$ only, when the material into which the ions are injected contains C.

The ion source for increasing the surface hardness of the ejection side surface can include N gas, Si containing gas such as $SiF_4$, $SiCl_4$ or the like, a combination of $BCl_3$ gas and $NH_3$ gas, or the like. They are in the form of a gas under normal or reduced pressure.

The usable ions extracted from the ion source include $N^+$, Si containing ion such as $Si^+$ or $SiCl_3^+$ or the like, an combination of $B^+$ and $N^+$.

The usable ion source for providing electroconductivity contains a metal compound which is in the form of a gas under normal or reduced pressure such as $(C_2H_5)_3Al$, $WF_6$, $MoCl_5$ or the like.

The usable ions extracted from the ion source include metal ions such as $Al^+$, $N^+$ $Mo^+$, $W^+$ or the like.

The ion accelerating voltage is 5–100 keV, preferably 10–60 keV. The distribution of injected ions in the material is in the form of a Gaussian distribution, and therefore, there is an optimum value of the ion accelerating voltage in the above mentioned range. If it is smaller than 5 keV, the stability of ion acceleration is lost. If it is larger than 100 eV, the ions penetrate too deeply, and therefore, the efficient surface improvement is deteriorated, and the surface may be overheated.

The dose amount is $1\times10^{14}$–$1\times10^{8}$ $cm^{-2}$, preferably $1\times10^{15}$–$1\times10^{17}$ $cm^{-2}$. If it is smaller than $1\times10^{14}$ $cm^{-2}$, the water repelling property is not sufficient. If it is larger than $1\times10^{18}$ $cm^{-2}$, the material will overheat.

The water repelling property by the ion injection can be effected to any material constituting the ink jet recording head, such as and organic compound or inorganic compound such as semiconductor (Si or the like), glass, ceramic material, oxide of semiconductor, organic polymer or organic resin material.

After the ion injection process, a heating process may be carried out for the purpose of enhancing the water repelling nature.

The ion injection method for the surface property improvement is not limited to the type described above. For example, a DC plasma CVD method or the like is usable.

Figure 5:
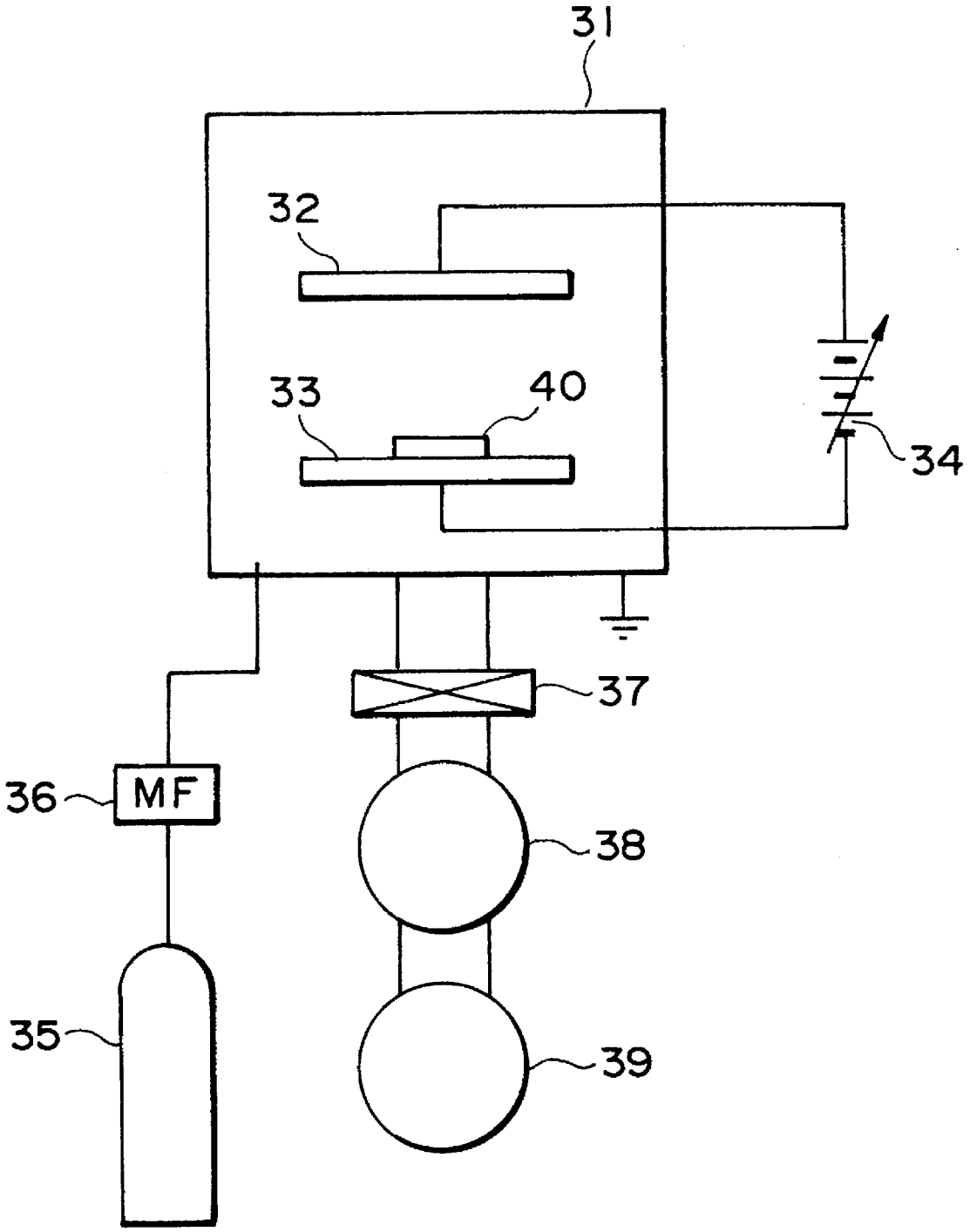
FIG. 5 is a schematic illustration of a DC plasma CVD apparatus.

FIG. 5 shows an example of the DC plasma CVD apparatus. In a chamber 31, there are provided an anode 32 and a cathode 33, to which a DC voltage source 34 is connected. A gas is supplied to them through a mass flow 36 from a gas container.

An exhaust system comprises a gate valve 37, a turbo molecular pump 38 and a rotary pump 39. On the cathode 33, the recording head 40 is placed with the ejection side surface facing up.

The gasses usable for the purpose of the surface property improvement, include any gasses that contain C and F such as $CF_4$, $C_2F_6$, $CHF_3$ or the like which is in the form of a gas under the normal or reduced pressure. The operating conditions are 0.1–5 Torr gas pressure, 0.05–10 $mA/cm^2$ current, preferably.

The water repelling property by the ion injection according to the present invention provides the following advantages:

(1) The surface hardness of the ejection side surface of the orifice plate can be increased: and (2) The ejection side surface of the orifice plate can be given the electric conductivity.

The ion machining apparatus of FIG. 3 and the ion injector apparatus of FIG. 4 are both operated under high vacuum, a converging ion beam function may be added to the ion injector, thus permitting continuous processing operations. More particularly, if the performance of the beam scanning system and the objective lens in the ion injector is improved, and if the secondary electron detecting system is added, both the ion machining and the ion injection can be carried out by a single apparatus although the ion source is to be exchanged.

In this case, the ejection side surface formation and the water repelling treatment can be carried out simultaneously.

In the foregoing, the description has been made as to the water repelling property given by the ion injection method. However, if the ions to be injected are changed, hydrophilic property can be easily given. In this case, the ions may be any that give the hydrophilic property. They include $O^+$, $H^+$, $Au^+$ or the like. They may be used alone or in combination.

The operating conditions in the ion injection are the same as have been described in connection with the water repelling property treatment.

Figure 6:
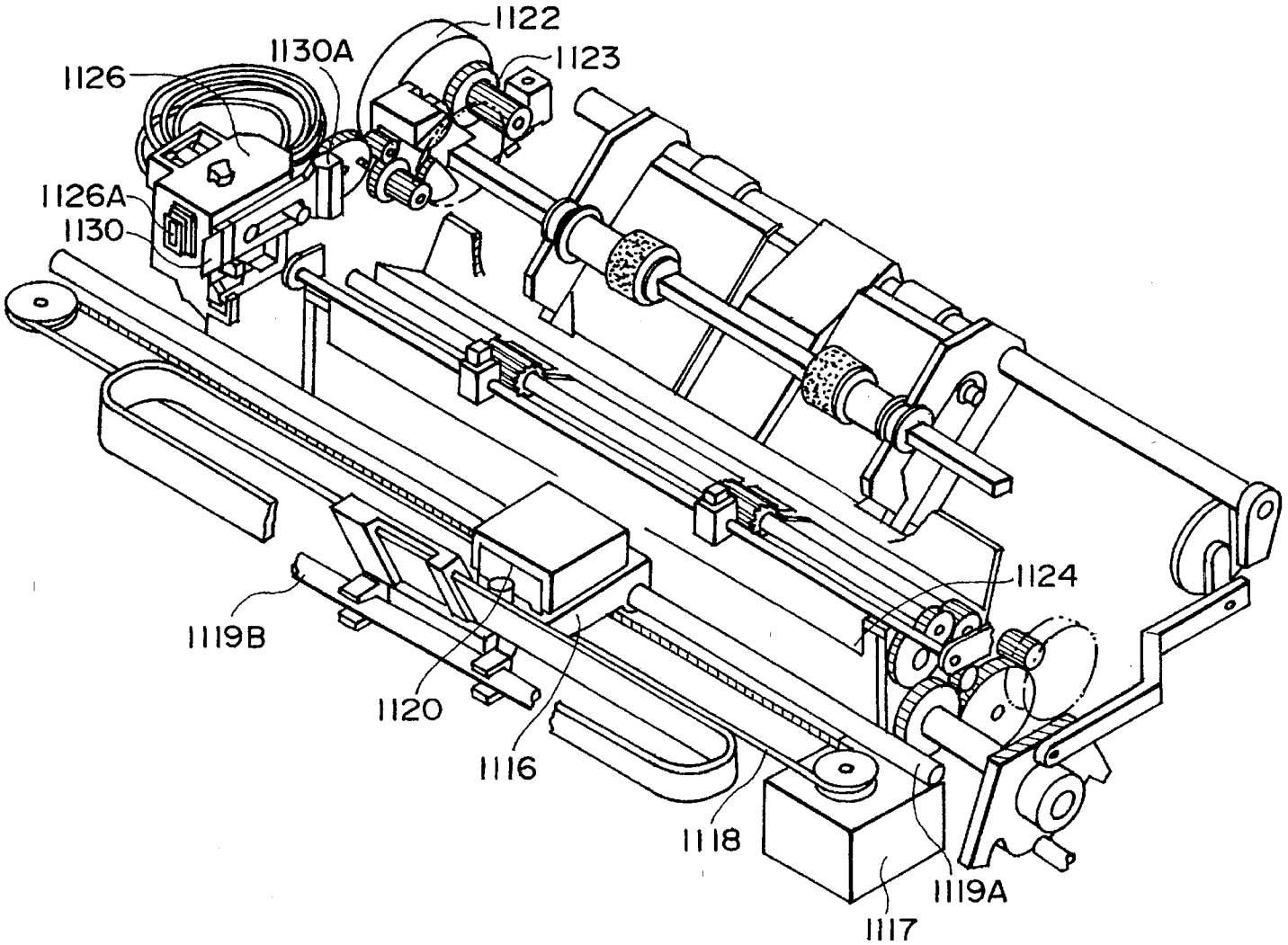
FIG. 6 is a perspective view of an example of a recording apparatus to which the present invention is applicable.

Referring to FIG. 6, there is shown an example of an ink jet recording apparatus IJRA loaded with an ink jet head cartridge IJC having a recording head according to an embodiment of the present invention.

The ink jet head cartridge is indicated by a reference numeral 1120 and is provided with a plurality of nozzles for ejecting the ink onto a recording surface of a fed recording material. It is supported on a carriage 1116, which is connected with a part of a driving belt 1118 for transmitting the driving force from a driving motor 1117. The carriage 1116 is slidably supported on two guiding shafts 1119A and 1119B extended in parallel with each other, so that reciprocating movement is possible to cover the entire width of the recording sheet.

A recording head recovery device 1126 is disposed at an end of a reciprocation path of the ink jet cartridge 1120, for example a home position. By the driving force of the motor 1122, the head recovery device 1126 is operated through a transmission mechanism 1123, and the ink jet cartridge 1120 is capped. In interrelation with the capping action, the ink is cleared by sucking means in the head recovery device 1126, or the ink is pressure-fed by suitable pressure means disposed in the ink supply passage to the ink jet cartridge 1120, so that the ink is forcedly discharged through the ejection outlets, by which the thickened ink is removed from the nozzle. Upon the completion of the recording operation, the head is capped to protect the ink jet recording head.

A wiping member in the form of a blade 1130 is disposed at a side of the head recovery device 1126 and is made of silicone rubber. The blade 1130 is supported in a cantilevered supporting manner on a blade supporting member 1130A. Similarly to the head recovery device 1126, it is operated by the motor 1122 and through the transmission mechanism 1123 to permit engagement with the ejection side surface of the ink jet head cartridge 1120. Thus, at proper timing in a recording operation of the ink jet cartridge 1120, or after the ejection recovery process operation using the head recovery device 1126, the blade 1130 is projected into the moving path of the ink jet cartridge 1120, so that any condensed moisture ink dust or the like is removed from the ejection side surface of the ink jet cartridge 1120 during the movement thereof.

The embodiments of the present invention will be described. First, an embodiment in which the ions are injected into the ejection side surface to provide the water repelling property.

Figure 7:
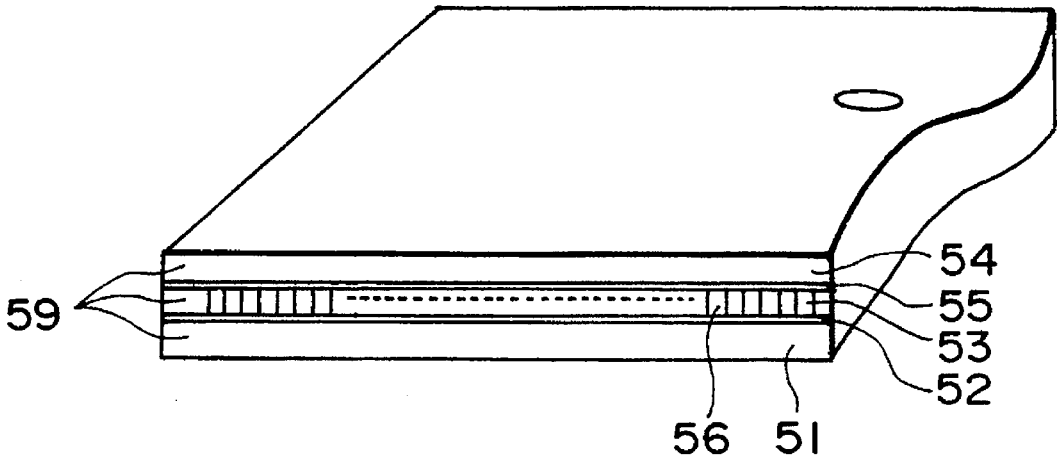
FIG. 7 is a perspective view of an example of a recording head according to an embodiment of the present invention.

Referring to FIG. 7, a line recording head is treated for the water repelling property. The recording head is manufactured in the following manner. A lower $SiO_2$ layer is formed on a first substrate in the form of a silicon wafer 51, and a heat generating element 52 (ejection pressure generating element) is formed thereon. Further thereon, nozzle walls 53 are formed of photosensitive acrylic resin material through photolithography. An acrylic resin material is applied as a bonding layer 55 on a second substrate 54 of glass, and it is bonded on the nozzle walls 53. Finally, the first substrate 51, the nozzle walls 53 and the second substrate 54 are simultaneously cut, thus forming the ejection outlets 56. At the ejection side surface 59, there are four materials, namely, silicon, $SiO_2$, acrylic resin material and glass. Such an ejection side surface 59 is treated for the surface property improvement under the following conditions.

Embodiment 1

Figure 8:
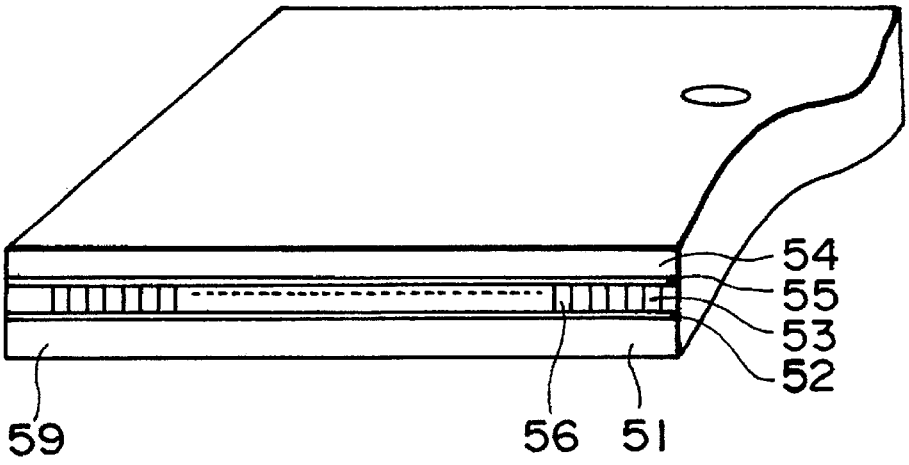
FIG. 8 is a perspective view of a recording head of FIG. 7 in which the ejection side surface of the recording head has been machined.

The ejection side surface 59 of the head shown in FIG. 7 was coated with Ni to a thickness of 0.2 micron through evaporation method. For the purpose of water repelling property, $C_2F_4^+$ ions are injected into the ejection side surface 59 in a direction perpendicular thereto with an acceleration energy of 20 keV and with a dose of $1\times10^{16}$ $cm^{-2}$. In this manner, a recording head having been treated for the water repelling property at the ejection side surface thereof, has been manufactured as shown in FIG. 8.

Embodiment 2

Similarly to Embodiment 1, the Ni layer is formed on the ejection side surface 59 of the recording head. Subsequently, $C_2F_4^+$ ions for providing the water repelling nature were injected into the ejection side surface 59 in a direction perpendicular thereto with an acceleration energy of 20 keV and the dose of $1\times10^{16}$ $cm^{-2}$. Then, in order to enhance the surface hardness, $N^+$ ion are injected under the same conditions with an acceleration energy of 20 keV but with a dose of $2\times10^{16}$ $cm^{-2}$.

Embodiment 3

Similarly to Embodiment 1, the Ni layer is formed on the ejection side surface 59 of the recording head, and then, $C_2F_4^+$ ions are injected into the ejection side surface 59 with the acceleration energy of 20 keV and dose of $1\times10^{16}$ $cm^{-2}$ in the direction perpendicular to the ejection side surface to provide the ejection side surface 59 with the water repelling property. Subsequently, in order to provide the surface with the electroconductivity, $Al^+$ ions are similarly injected with an acceleration energy of 20 keV and the dose of $1\times10^{15}$ $cm^{-2}$.

Embodiment 4

Similarly to Embodiment 1, the Ni layer is formed on the ejection side surface of the recording head, and then, $C_2F_4^+$ ions are injected in the direction perpendicular to the ejection side surface 59 with an acceleration energy of 20 keV and dose of $1\times10^{16}$ $cm^{-2}$ to provide the surface with the water repelling property. Subsequently, in order to enhance the surface hardness of the ejection side surface, $N^+$ ions are injected in the similar direction with the acceleration energy of 20 keV and a dose of $1\times10^{16}$ $cm^{-2}$. Additionally, in order to provide the ejection side surface with the electroconductivity, the $Al^+$ ions are injected in the same conditions with an acceleration energy of 20 keV and dose of $1\times10^{15}$ $cm^{-2}$.

Embodiment 5

The ejection side surface of a recording head having the heat generating elements as shown in FIG. 7 is coated with carbon through a sputtering method to a thickness of 0.2 micron. Subsequently, in order to provide the surface with the water repelling property, $F^+$ ions are similarly injected with an acceleration energy of 40 keV and the dose of $5\times10^{16}$ $cm^{-2}$.

Embodiment 6

Figure 1:
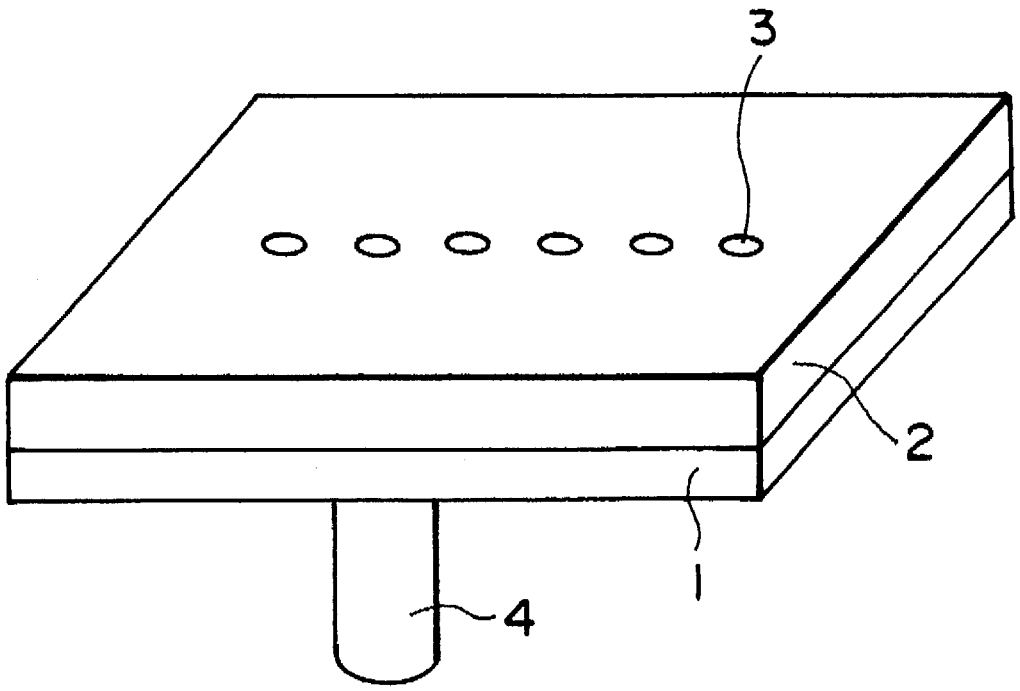
FIG. 1 is a schematic perspective view of an example of a conventional recording head.
Figure 2:
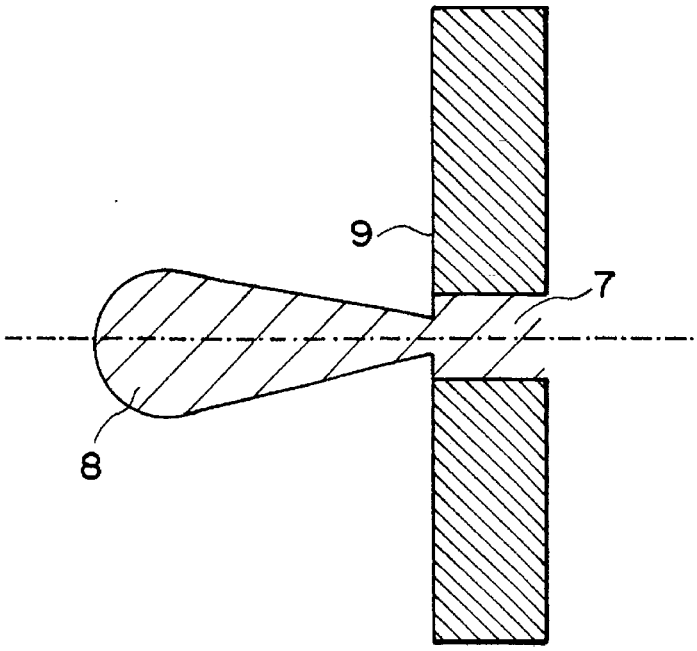
FIGS. 2(A) and 2(B) illustrate ink ejection.
Figure 2:
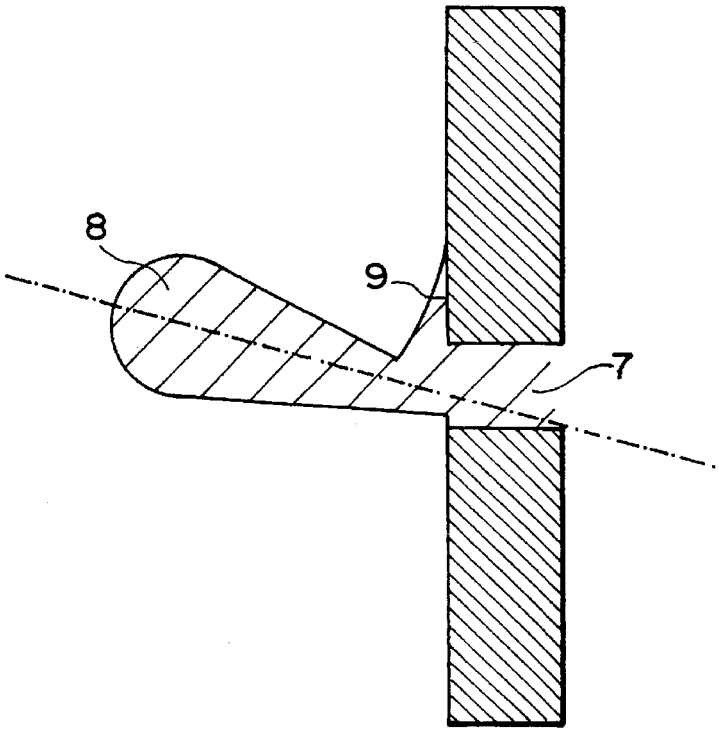
Figure 9:
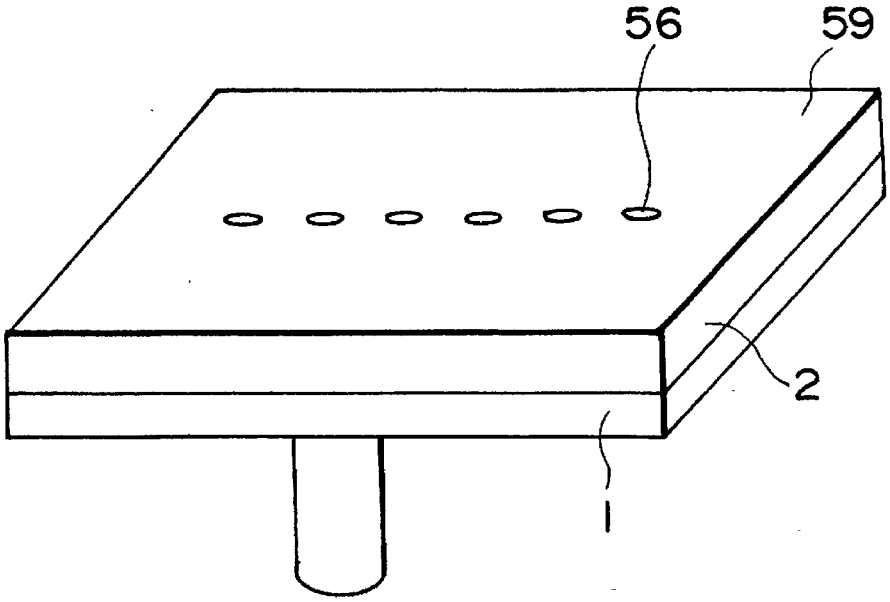
FIG. 9 is a perspective view of another example of the recording head.

Ejection outlets are formed through photolithography in an orifice plate 2 of stainless steel having the structure shown in FIG. 1. It is coated with carbon through sputtering to a depth of 0.2 micron. Subsequently, the orifice plate surface is injected with $F^+$ ions with an acceleration energy of 40 keV and the dose of $5\times10^{16}$ $cm^{-2}$ to give the water repelling property. The orifice plate is bonded to the ink jet recording head substrate having the nozzle walls or the like formed therein. FIG. 9 shows the thus manufactured recording head.

Comparison Example 1

A recording head as shown in FIG. 8 has been manufactured through a process similar to that of Embodiment 1 except that fluorine resin material (DEFEN7710, trade name available from DIK) has been transferred onto the ejection side surface by the rubber elastic material transfer method.

The ink ejecting operations were carried out with the above-described recording heads under the following conditions:

Signal pulses:

Pulse width: 10 μsec

Pulse frequency: 3 kHz

Applied energy: 0.02 mJ/pulse (per heat generating element)

Ink:

Water: 70%

Diethylene glycol: 26%

Direct Black: 4%

Under these conditions, stabilized ejection and accurate record positions could be maintained over more than $10^9$ pulses.

In the ink jet recording head having the ejection side surface treated in accordance with the above-described embodiments, the ejection side surface is not non-uniformly wetted and therefore, the ink droplet ejecting direction is stabilized, so that the high quality prints and images can be produced.

The ink jet recording head of the foregoing embodiments are loaded in a printer and the ejection side surface is wiped a plurality of times by urethane rubber blade, silicone rubber blade, and butyl rubber blade, and the printing performance is evaluated thereafter. Table 1 shows the results when the urethane rubber blade is used.

TABLE 1

Results of Wiping Test

| | Level 1 | Level 2 | Level 3 |
|---|---|---|---|
| Embodiments 1, 3, 5 & 6 | G | G | N |
| Embodiments 2 & 4 | G | G | G |
| Comp. Example | N | N | N |

Level 1: 2000 wiping operations
Level 2: 10000 wiping operations
Level 3: 30000 wiping operations
Evaluation G: Good
Evaluation N: Improper print (shot position deviation is remarkable)

The above results are the same with the other blade materials. This is because of the increase of the strength of the election side surface and the increase of the wear-resistance thereof. For this reason, the design latitude is enhanced, and the cost reduction is possible.

The recovery operation of rubbing the ejection side surface of the recording head loaded in the recording apparatus by rubbing with a sponge, was carried out a plurality of times, and the print performance is evaluated. Table 2 shows the results.

TABLE 2

| | Level 1 | Level 2 | Level 3 |
|---|---|---|---|
| Embodiments 1, 3, 5 & 6 | G | G | N |
| Embodiments 2 & 4 | G | G | G |
| Comp. Example | G | N | N |

Level 1: 100 recovery operations
Level 2: 500 recovery operations
Level 3: 1000 recovery operations
Evaluation G: Good
Evaluation N: No good (remarkable shot position deviation)

As will be understood from Table 2, the water repelling property is not deteriorated in the tests in which contact type recovery means is used. Therefore, the contact type recovery system is usable. Therefore, the recovery operation is assured.

Even when the ejection side surface is made of a plurality of materials, the smoothness and the water repelling property of the ejection side surface are uniform because the ions are injected after the ejection side surface is constituted. Therefore, very good ejection is possible.

By ion injection of $F^+$ ions after the formation of the carbon coating on the ejection side surface as in Embodiments 5 and 6, the sufficient water repelling nature could be given even with the material exhibiting difficulty in providing the water repelling nature only by the ion injection.

In Embodiments 2–4, the properties other than the water repelling property are provided for the ejection side surface.

In the recording head of Embodiment 2, the water repelling property is given by $C_2F_4^+$ ions. In addition, by the injection of $N^+$ ions, the mechanical strength of the nozzle walls of the resin material at the ejection side surface, the bonding layer and the orifice plate, is enhanced. Accordingly, durability has been improved more than in Embodiment 1.

Furthermore, the resistances of the ejection side surfaces of the recording heads manufactured in accordance with the Embodiments and Comparison Example were measured. In the recording heads of Embodiments 1, 2 and 5 and the Comparison Example, the resistances are in the range of $10^{13}$–$10^{14}$ ohm/□. On the other hand, in the recording heads of Embodiments 3 and 4, they are within the range of $10^{8}$–$10^{10}$ ohm/□.

With the recording head of Embodiment 3, the water repelling property is given by $C_2F_4^+$ ions. In addition, the $Al^+$ ions are injected, by which the electroconductivity is given to the ejection side surface. By doing to, the ejection side surface is not easily electrostatically charged with the result that the paper dust or the like is not easily deposited. Therefore, improper printing due to the paper dust or the like can be minimized.

As regards the recording head of Embodiment 4, further advantageous effects are provided by the combinations of Embodiments 2 and 3.

As described in the foregoing, the ink jet recording head provided with the water repelling property at the ejection side surface by the ion injection method is capable of stably ejecting the ink in a predetermined direction at all times with substantially uniform volumes of the liquid, and therefore, high speed recording is possible.

By injecting the ions after formation of the surface layer, the choice of the materials of surface layer and the choice of the ions are large. Therefore, a high hardness ejection side surface can be provided, so that the choice of the material of the blade for removing the paper dust or the like becomes larger. Additionally, a contact type recovery system for removing the foreign matter or ink which can not be removed by the blade, is usable.

By electroconductivity of the ejection side surface provided by the ion injection, the paper dust or the like is not easily deposited thereon, so that the number of removing operations can be reduced, thus permitting high speed long term printing.

As a result, the durability of the ink jet recording head is improved, and the choice of the printing or recording materials becomes larger.

Embodiment 7

Similarly to Embodiment 1, $C^+$ ions are injected into the ejection side surface of the recording head in a direction perpendicular thereto with accelerating energy of 20 keV and the dose of $1\times10^{16}$ $cm^{-2}$. Subsequently, in order to provide the water repelling property, $F^+$ ions are similarly injected with an acceleration energy of 20 keV and dose of $2\times10^{16}$ $cm^{-2}$.

Embodiment 8

The water repelling treatment has been effected to the ejection side surface of the orifice plate 2 of the recording head used in Embodiment 6, under the same conditions as in Embodiment 1, with the exception that the Ni layer is not formed.

Embodiment 9

The water repelling property treatment has been effected to the ejection side surface of the orifice plate 2 of the head used in Embodiment 6, under the same conditions as in Embodiment 7.

Embodiment 10–12

The water repelling property treatment has been effected to the ejection side surface of the orifice plate used in Embodiment 6 under the same conditions as in Embodiments 2–4, except that the Ni layer is not formed.

The ink ejection tests are carried out with the above-described recording heads under the following conditions:

Signal pulses:

Pulse width: 10 μsec

Pulse frequency: 3 kHz

Applied energy: 0.02 mJ/pulse (per heat generating element)

Ink:

Water: 70%

Diethylene glycol: 26%

Direct Black: 4%

It has been confirmed that the stabilized ejection with high shot position accuracy could be maintained over more than $10^9$ pulses.

The ejection side surface of the recording head which has been treated according to each of the above-described embodiments, is not non-uniformly wetted, and therefore, the ejection direction thereof is stabilized, so that the high print quality can be provided. The ink jet recording head of these embodiments are loaded in a printer and the printing operations are carried out. As a result, the strength of the water repelling surface against the blade for removing the paper dust or the like, has been improved, and the wear-resistance is improved, and therefore, various materials are usable for the blade. Thus, the latitude of the design is increased, and the cost can be reduced. In addition, when the contact type recovery system is used, the water repelling property does not decrease, and therefore, the contact type recovery system is usable. Thus, the recovery operation is assured.

In the case that $N^+$ ions are injected, the mechanical strength of the ejection side surface has been improved. When the $Al^+$ ions are injected, the electroconductivity is given to the-ejection side surface, so that the triboelectric charge can be suppressed with the result that paper dust is not easily deposited.

Embodiment 13

The ion injection is possible using a CVD apparatus shown in FIG. 5 in place of the apparatus shown in FIG 4. In the embodiment, the initial vacuum is 7E–7 Torr and the distance between the electrodes was 60 mm with the diameter of the electrodes being 30 cm. The discharge was carried out under the condition shown on Table 3. The recording head used was the same as in Embodiment 1. As a result of electric discharge under these conditions the recording head was not etched or charged, and therefore, the surface property improvement and the water repelling property were confirmed.

Using such a recording head, the ink ejection tests were carried out with the following signal pulse conditions:

Printing pulse: 10 μsec

Pulse frequency: 3 kHz

Print energy: 0.02 mJ/pulse (per heat generating element)

As a result, the stabilized ejections with correct ink shot positions can be maintained over more than $10^9$ ejections.

TABLE 3

| Experimental Conditions | |
|---|---|
| Gas | $C_2F_6$ |
| Current source | 400 mA Const. |
| Gas pressure | 0.7 Torr |
| Gas flow | 70 sccm |
| Discharge time | 30 min. |

The ink ejection outlets of the jet recording head having the ejection side surface treated in accordance with this embodiment are not wetted non-uniformly, and therefore, the ink droplet ejection direction is stabilized, and the print and image qualities were good.

Embodiment 14

The experiment conditions were as follows:

TABLE 4

| Experimental Conditions | |
|---|---|
| Gas | $CF_4/H_2$ (80%) |
| Current source | 400 mA Const. |
| Gas pressure | 0.5 Torr |
| Gas flow | 50 sccm |
| Discharge time | 30 min. |

A mixture gas of $CF_4$ and $H_2$ was used, and the similar experiments as in Embodiment 13 were carried out.

Under these conditions, satisfactory water repelling property, durability of the property and the print durability were satisfactory.

Embodiment 15

Experiment conditions were as follows:

TABLE 5

| Experimental Conditions | |
|---|---|
| Gas | $CHF_3$ |
| Current source | 400 mA Const. |
| Gas pressure | 0.9 Torr |
| Gas flow | 50 sccm |
| Discharge time | 40 min. |

The sufficient water repelling properties, and the durabilities of the properties, and the print durabilities were satisfactory with these conditions.

Embodiment 16

TABLE 6

| Experimental Conditions | |
|---|---|
| Gas | $CHF_3$, $H_2$ |
| Current source | 400 mA Const. |
| Gas pressure | 0.4 Torr |
| Gas flow | $CHF_3$: 10 sccm<br>$H_2$: 40 sccm |
| Discharge time | 60 min. |

Two gas containers for $CHF_3$ and $H_2$ were used as shown in Table 6, and the experiments have been carried out as in Embodiment 13.

The sufficient water repelling property, the durability of the property, and the print durability were satisfactory with these conditions.

With respect to these recording head, the following evaluations were made.

(1) Blade Wiping Test

The ejection side surface was wiped a plurality of times by a urethane blade, and the printing operations were carried out thereafter. The results are shown in Table 7.

TABLE 7

| | Level 1 | Level 2 | Level 3 |
|---|---|---|---|
| Embodiments 7, 8, 9, 11, 13 14, 15 & 16 | G | G | N |
| Embodiments 10 & 12 | G | G | G |

Level 1: number of wiping operations: 2000
Level 2: number of wiping operations: 10000
Level 3: number of wiping operations: 30000
Evaluation G: Good printing
Evaluation N: Improper printing (remarkable deflection)

(2) Recovery Test

Rubbing recording operation was carried out a plurality of times by a sponge (trade name: Belclean), and thereafter, the printing operations were carried out, and the prints were evaluated. The results are shown in Table 8.

TABLE 8

| | Level 1 | Level 2 | Level 3 |
|---|---|---|---|
| Comp. Example | G | N | N |
| Embodiments | G | G | N |

TABLE 8-continued

| | Level 1 | Level 2 | Level 3 |
|---|---|---|---|
| 7, 8, 9, 11, 13 14, 15 & 16 Embodiments 10 & 12 | G | G | G |

Level 1: number of wiping operations: 100
Level 2: number of wiping operations: 500
Level 3: number of wiping operations: 1000
Evaluation G: Good printing
Evaluation N: Improper printing (remarkable deflection)

(3) Electric Conductivity

The electroconductivity of the part for which the surface property is improved by ion injection, was measured. The results are shown in Table 9.

TABLE 9

| | Conductivity |
|---|---|
| Embodiments 7, 8, 9, 11, 13 14, 15 & 16 | $10^{13}$–$10^{14}$ Ω/□ |
| Embodiments 10 & 12 | $10^{8}$–$10^{10}$ Ω/□ |

As described in the foregoing, according to the present invention, the ions are injected into the ejection side surface of an ink jet recording head to improve the surface property. With this ion injection method, the material of the ejection side surface is improved, and therefore, the adhesion is satisfactory. By properly selecting the ions to be injected, the hardness as well as the water repelling property is improved, and electroconductivity can be given.

In addition, the property of the surface can be improved in any material, and this improvement can be effectively made even when the ejection side surface is made of different materials.

The recording head manufactured through the above-described process can stably eject a substantially constant volume of ink in a predetermined direction at all times, and the high speed recording is sufficiently carried out with satisfactory durability.

In addition, such an ink jet recording head does not require a specific recording material.

More particularly, the following advantages can be provided by using the ejection side surface having the water repelling property resulting from the surface property improvement:

1. Print durability.
2. Durability against blade for removing the paper dust or the like.
3. A contacting recovery system is usable.

By increasing the hardness of the surface by the surface improvement, the above-described advantages can be enhanced.

By making the ejection side surface electroconductive, the paper dust or the like is minimally deposited on the ejection side surface. When the surface improvement is made by using CVD, the recording head having excellent durability of the water repelling property can be manufactured by a less expensive apparatus. When an Rf P-CVD apparatus is used for forming film of the recording head, what is required is to exchange the voltage source only. In addition, simultaneous processing is possible for the part corresponding to the area of the cathode, and therefore, the productivity is high.

The description will be made as to embodiments in which the ejection side surface is provided with the water repelling property by ion injection, and the ejection outlets are formed by ion machining.

Embodiment 7

Figure 10:
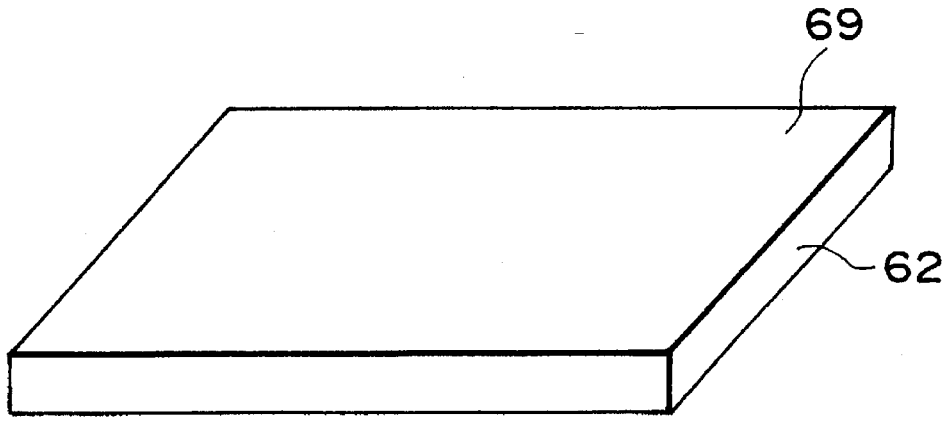
FIG. 10 shows a blank of the recording head.
Figure 11:
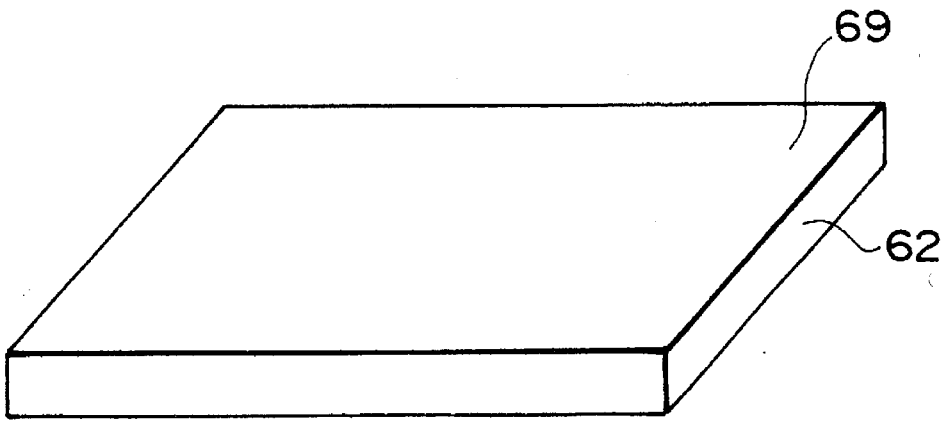
FIG. 11 is a recording head at a step of the manufacturing process thereof.

As shown in FIG. 10, $C_2F_4^+$ ions injected for providing the water repelling nature were injected into an orifice plate 62 surface 69 made of polysulfone resin with an acceleration energy of 20 keV, and the dose of $1\times10^{16}$ $cm^{-2}$ in a direction perpendicular to the surface. By doing so, the orifice plate shown in FIG. 11 is provided with a surface treated for the water repelling property.

Figure 12:
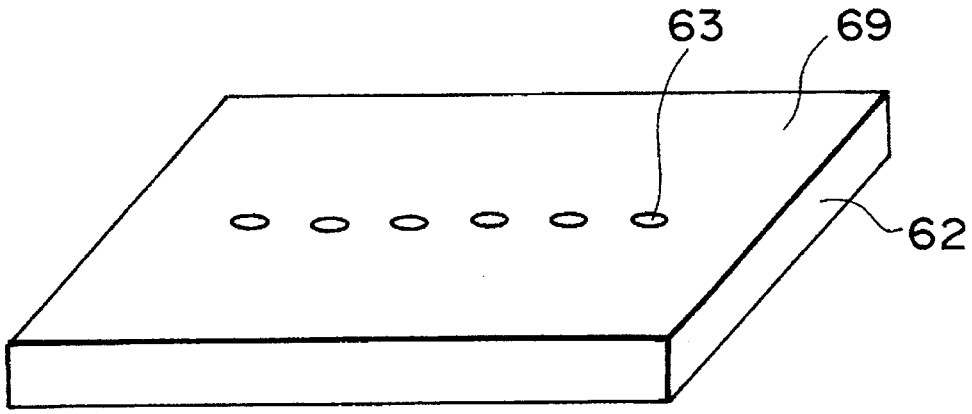
FIG. 12 is a recording head at a step of manufacturing the same.

Subsequently, using FIB shown in FIG. 3, the etching operation is carried out by etching ions $Ga^+$ with the acceleration energy of 200 keV, beam diameter of 1 micron and beam current of 500 pA. The ejection outlets 63 of 15 microns diameter were formed at 30 microns pitch, as shown in FIG. 12.

In this embodiment, the ion injection and the ion machining were carried out by different apparatuses. However, as described in the foregoing, both apparatuses may be combined into one apparatus, and this is advantageous for mass-production. The orifice plate was bonded to an ink jet recording head having nozzle walls or the like therein to provide the ink jet recording head shown in FIG. 1.

Embodiment 18

The $C^+$ ions are injected into the orifice plate surface 69 with an acceleration energy of 20 keV and dose of $1\times10^{16}$ $cm^{-2}$ in the direction perpendicular to the surface of the orifice plate. Subsequently, the $F^+$ ions are injected with the acceleration energy of 20 keV and an dose of $2\times10^{16}$ $cm^{-2}$ to provide the ejection side surface with the water repelling property. The ink jet recording head was thus produced with the other conditions being the same as in Embodiment 16.

Embodiment 19

The water repelling property providing $C_2F_4^+$ ions are injected into the orifice plate surface with an acceleration energy of 20 keV and the dose of $1\times10^{16}$ $cm^{-2}$ in the direction perpendicular to the surface of the orifice plate. In order to improve the surface hardness, $N^+$ ions are injected under similar condition with acceleration energy of 20 keV and the dose of $2\times10^{16}$ $cm^{-2}$. The ink jet recording head was produced in the same manner as in Embodiment 1 in the other respects.

Embodiment 20

To provide the orifice plate surface 59 with the water repelling property, $C_2F_4^+$ ions are injected perpendicularly into the orifice plate surface with acceleration energy of 20 keV and dose of $1\times10^{16}$ $cm^{-2}$. In order to render it electroconductive $Al^+$ ion are-similarly injected with an acceleration energy of 20 keV and dose of $1\times10^{15}$ $cm^{-2}$. The ink jet recording head was produced in the same manner as in Embodiment 16 in other respect.

Embodiment 21

In order to provide the orifice plate surface 59 with the water repelling property, $C_2F_4^+$ ions are injected into the orifice plate in the direction perpendicular thereto with an acceleration energy of 20 keV and dose of $1\times10^{16}$ $cm^{-2}$. Subsequently, in order to improve the surface hardness, $N^+$ ions are injected similarly with the acceleration energy of 20 keV and the dose of $1\times10^{16}$ $cm^{-2}$. Furthermore, in order to render it electroconductive, $Al^+$ ions are similarly injected with acceleration energy of 20 keV and dose of $1\times10^{15}$ $cm^{-2}$. The ink jet recording head was produced in the same manner as in Embodiment 16 in other respects.

Those recording heads were operated with the following conditions:

Signal pulses:

Applied pulse width: 10 μsec

Pulse frequency: 3 kHz

Applied energy: 0.01 mJ/pulse (per heat generating element)

Ink:

Water: 70%

Diethylene glycol: 26%

Direct Black: 4%

It has been confirmed that the ejection outlet are arranged at such a high density as 30 microns pitch, the stabilized ejection with accurate shot position can be obtained over more than $10^9$ pulses.

In the ink jet recording head having the ejection side surface treated in the manners described in the foregoing embodiments, the ejection side surface is not wetted non-uniformly, and therefore, the ink droplet ejection direction is stabilized, so that high print and image quality can be provided.

The highly accurate machining by the ion machining for the ejection outlets and the perpendicular shape in the cross-section, can provide proper ejection, and therefore, high printing and image qualities.

The ink jet recording heads according to Embodiments 17–21, are loaded in a printer, and the ejection side surface was wiped a plurality of times by blades of urethane rubber, silicone rubber and butyl rubber. Then, the printing performance was evaluated (blade wiping test). Table 10 shows the results of test.

TABLE 10

| | Level 1 | Level 2 | Level 3 |
|---|---|---|---|
| Embodiments 17, 18 & 20 | G | G | N |
| Embodiments 19 & 21 | G | G | G |

Level 1: number of wipings: 2000
Level 2: number of wipings: 10000
Level 3: number of wipings: 30000
Evaluation G: Good printing
Evaluation N: Improper printing (remarkable deflection)

The results are the same as with the other blade. This is because the strength of the water repelling surface of the recording head is improved, and the durability is improved. Therefore, the latitude of the design is increased, and the cost can be reduced.

Furthermore, a sponge is contacted to the ejection side surface of the recording head in a recording apparatus, and the ejection side surface was subjected to the recovery operation using the sponge a plurality of time, and the evaluation was made. The results are shown in Table 11.

TABLE 11

| | Level 1 | Level 2 | Level 3 |
|---|---|---|---|
| Embodiments 17, 18 & 20 | G | G | N |
| Embodiments 19 & 21 | G | G | G |

Level 1: number of recovery operations: 100
Level 2: number of recovery operations: 500
Level 3: number of recovery operations: 1000
Evaluation G: Good printing
Evaluation N: Improper printing (remarkable deflection)

As will be understood from Table 11, the water repelling property is not deteriorated in the contact type recovery system using tests. Therefore, the contact type recovery system is usable. Thus, the recovery operation is assured.

According to Embodiments 19–21, the surface hardness is improved, and conductivity is given, in addition to the water repelling property of the ejection side surface. The description will be made in this respect further.

In the recording head of Embodiment 19, the water repelling property is given by $C_2F_4^+$ ions. In addition, by the injection of $N^+$ ions, the mechanical strength of the nozzle walls of the resin material at the ejection side surface, the bonding layer and the orifice plate is enhanced. Accordingly, the durability has been improved more than in Embodiments 17 and 18.

Furthermore, the resistance of the ejection side surfaces of the recording heads manufactured An accordance with the Embodiments 17–21, were measured. In the recording heads of Embodiments 18 and 19, the resistances are in the range of $10^{13}$–$10^{14}$ ohm/□. On the other hand, in the recording heads of Embodiments 20 and 21, they are within the range of $10^8$–$10^{10}$ ohm/□.

With the recording head of Embodiment 20, the water repelling property is given by $C_2F_4^+$ ions. In addition, the $Al^+$ ions are injected, by which electroconductivity is given to the ejection side surface. By doing so, the ejection side surface is not easily electrostatically charged with the result that the paper dust or the like are not easily deposited. Therefore, the proper printing could be maintained for a long term.

As regards the recording head of Embodiment 20, the further advantageous effects of printing performance and durability are provided by The combinations of Embodiments 17, 19 and 20.

As described, highly dense, highly accurate, and fine ejection outlets can be formed by the ion machining. By adjusting the ion beam diameter, the ejection outlets without taper can be formed, and therefore, high quality printing is possible with a high density of dots.

As described in the foregoing, the ink jet recording head provided with the water repelling property at the ejection side surface by the ion injection method is capable of stably ejecting the ink in a predetermined direction at all times with substantially uniform volumes of the liquid, and therefore, high speed recording is possible.

By injecting the ions which provides high ejection side surface, the choice of the materials of the surface layer and the choice of the ions are large. Therefore, a high hardness ejection side surface can be provided, so that the choice of the material of the blade for removing the paper dust or the like becomes larger. Additionally, a contact type recovery system for removing the foreign matter or ink which can not be removed by the blade is usable.

By virtue of the electroconductivity of the ejection side surface provided by the ion injection, paper dust or the like is not easily deposited thereon, so that the number of removing operations can be reduced thus permitting high speed long term printing.

As a result, the durability of the ink jet recording head is improved, and the choice of the printing or recording materials becomes larger.

The description will be made as to Embodiments in which at least a part of ink contacting portion of the inside of the recording head is treated for hydrophilic property to prevent the bubble or bubbles stagnating inside the recording head so as to improve the ejection performance.

Figure 13A:
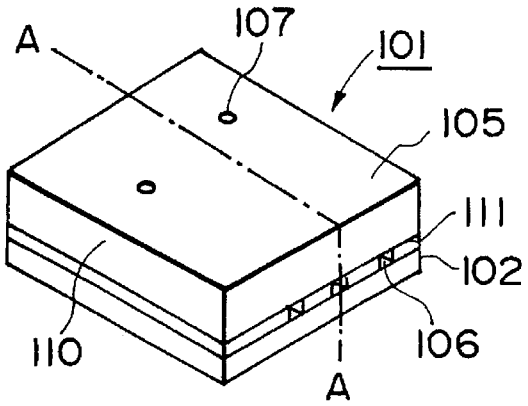
FIGS. 13A, 13B, 13C, 13D and 13E illustrate the manufacturing process of a recording head according to an embodiment of the present invention.

FIG. 13A is a perspective view of an ink jet recording head which has been treated for the hydrophilic property.

Figure 13C:
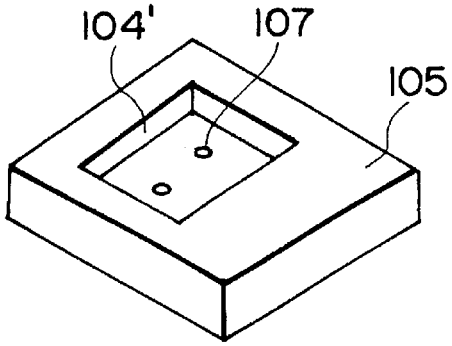
Figure 13D:
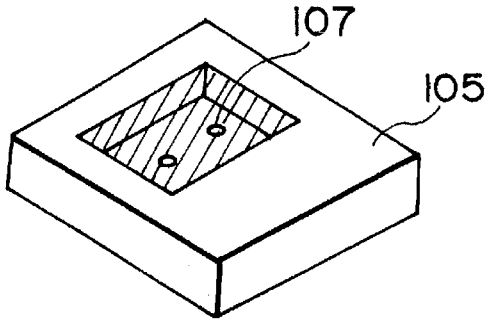
Figure 13B:
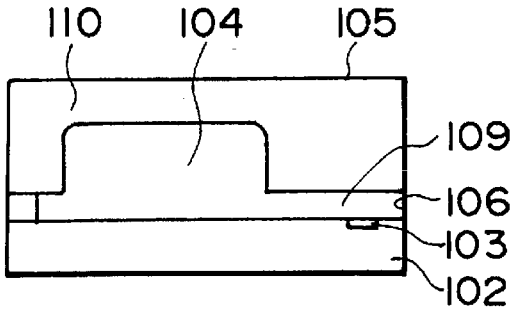

In FIG. 13A, the ink jet recording head comprises a substrate 102, ejection outlet 106, and an ink supply port 107. FIG. 13B is a sectional view taken along a line A—A in FIG. 13A. In FIG. 13B, reference numeral 103 is a heater for ejection energy generation: 104 is a liquid chamber; and 109 is ink passages.

In this invention, at least part of the ink jet recording head which is in contact with liquid. i.e., liquid chamber portion 104 of the top plate 105, the ink passage 109 or the like, is given the hydrophilic property by the ion injection method. In this cease, the material constituting the liquid contact portion may be a semiconductor (Si or the like), glass, ceramic material, oxide, nitride, carbide of semiconductor or organic compound such as organic polymer, or inorganic compound.

Figure 14A:
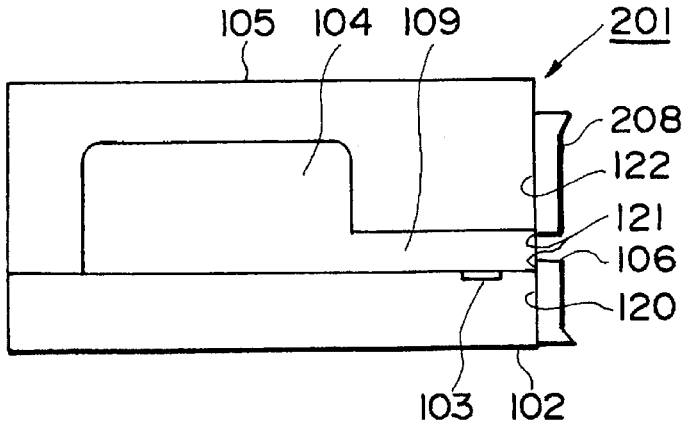
FIGS. 14A, 14B, 14C and 14D illustrate manufacturing steps of a recording head according to another embodiment.

FIG. 14A shows an example of the recording head having an orifice plate 108 having election outlet 106 at an end of passages 109. The orifice plate 108 is made of water repelling material. The backside 120 of the ejection outlets 106 of the plate 108 has been treated for the hydrophilic property, and therefore, the bubble does not stagnate at the joint portion 121 between the top plate 105, the substrate 102 and the orifice plate 108. The hydrophilic material is preferably eutectic plating of Teflon (trademark) fine particles and metal, such as Kaniflon (available from Japan Kanigen, Japan), or fluorine resin material such as Teflon, Cytop (available from Asahi Glassu Kabushiki Kaisha, Japan) or Defensa (Dainippon Ink Kogyo Kabushiki Kaisha, Japan).

Embodiment 22

Figure 13E:
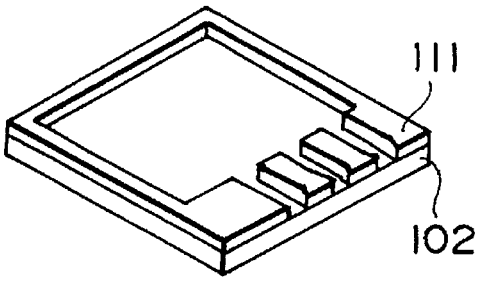

As shown in FIG. 13A and 13B, a lower layer in the form of $SiO_2$ layer (not shown) is formed on a silicon wafer substrate 102. On the lower layer, ejection energy generating elements 103 are formed. Subsequently, nozzle walls 111 are formed with photosensitive acrylic resin material through photolithographic system on the lower layer (FIG. 13E). As shown in FIG. 13C, a top glass plate 105 is formed with the ink supply port 107 and with the recess 104' for providing the liquid chamber 104. Subsequently, $O^+$ ions are injected into the recess surface 104' with and acceleration voltage of 30 keV and dose of $5\times10^{16}$ $cm^{-2}$. Then a plate 105 of glass is bonded on the nozzle walls 111. Finally, the substrate 102, the nozzle walls 111 end the glass top plate 105 are simultaneously cut to form the ejection outlet 106.

The recording head thus manufactured exhibits the hydrophilic property in the liquid chamber, and therefore, the bubble formation is less, and the bubble does not stagnate in the liquid chamber. Therefore, the bubble is not deposited in the liquid chamber. When the ink ejection was observed, the stabilized ejections are confirmed.

Embodiment 23

The recording head was manufactured in the same conditions as with Embodiment 22 except that in order to provide the hydrophilic nature, $H^+$ ions are injected with an acceleration energy of 20 keV and dose of $1\times10^{16}$ $cm^{-2}$.

Embodiment 24

Figure 14B:
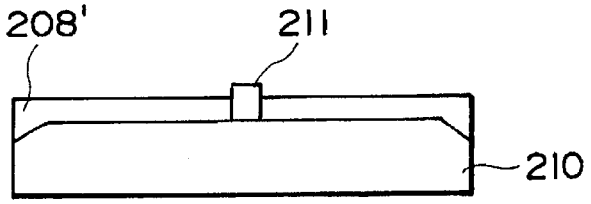

First of all, an orifice plate was manufactured. As shown in FIG. 14B, a pattern 211 corresponding to ejection outlets was formed by plating resist on a stainless steel plate 210. Thereafter, electroless Ni plating for providing the water repelling property was carried out to provide the plating layer 208'. This Ni electroless plating is called Kaniflon (available from Japan Kanigen, Japan) plating which is eutectic plating of Teflon (trademark) fine particles and Ni.

Figure 14C:
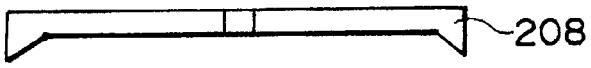

Subsequently, the plated resist 211 is dissolved by a solvent so that the plated layer 208' is removed from the stainless steel 210, so that the orifice plate 208 shown in FIG. 14C was provided.

Figure 14D:
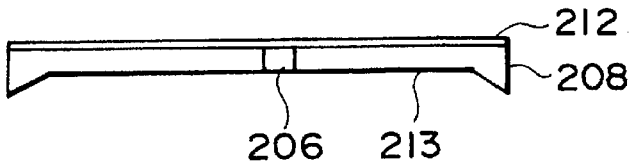

As shown in FIG. 14D, $O^+$ ions are injected through ion injection method into a surface opposite from the front surface 213 having the ejection outlets 206, with the acceleration voltage of 30 keV and dose of $5\times10^{16}$ $cm^{-2}$, thus providing the hydrophilic portion 212.

The orifice plate 208 thus treated for the hydrophilic property is secured to an end 122 by a spring (not shown) in such a manner that as shown in FIG. 14A the ion injected surface (hydrophilic portion 212) is faced to the end 122 of the ink passage 109 of the recording head 201 and that the ink passages are aligned with the ejection outlets. If desired, the orifice plate may be secured by bonding. To the recess surface of the top plate, $O^+$ ions are injected to provide the hydrophilic property as in Embodiment 22. The face surface of such an ink jet recording head is of water repelling material, and therefore it exhibits the water repelling nature. However,the inside is treated for the hydrophilic nature by the ion injection method.

Embodiment 25

An ink jet recording head was produced in the same manner as in Embodiment 24 except that the ions to be injected are $H^+$.

Embodiment 26

Figure 15A:
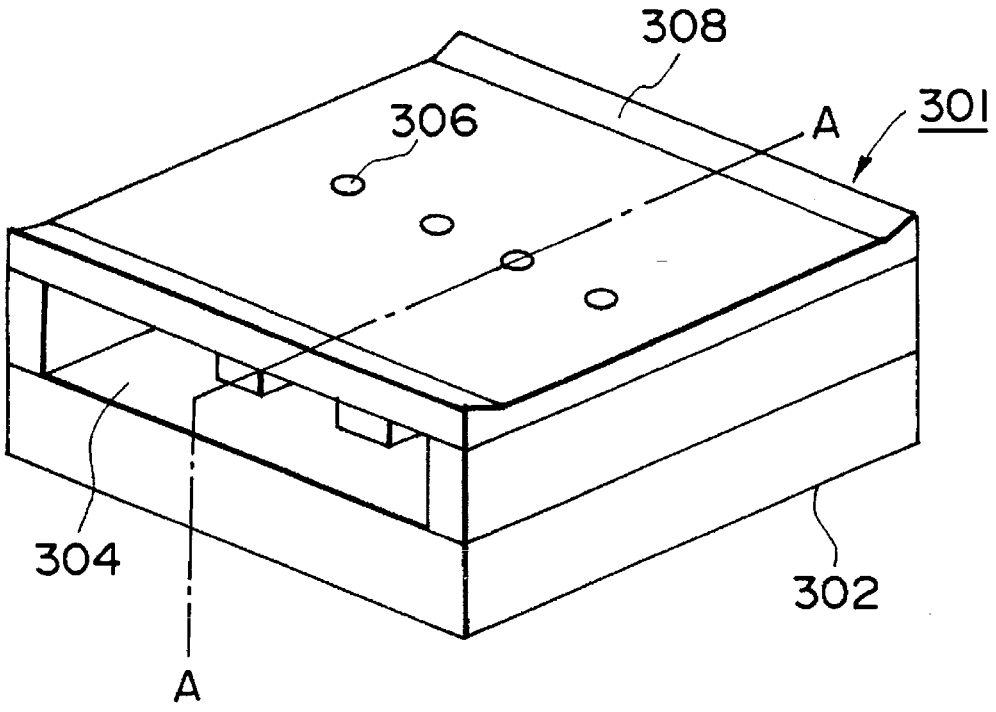
FIGS. 15A and 15B illustrate a recording head according to a further embodiment of the present invention.
Figure 15B:
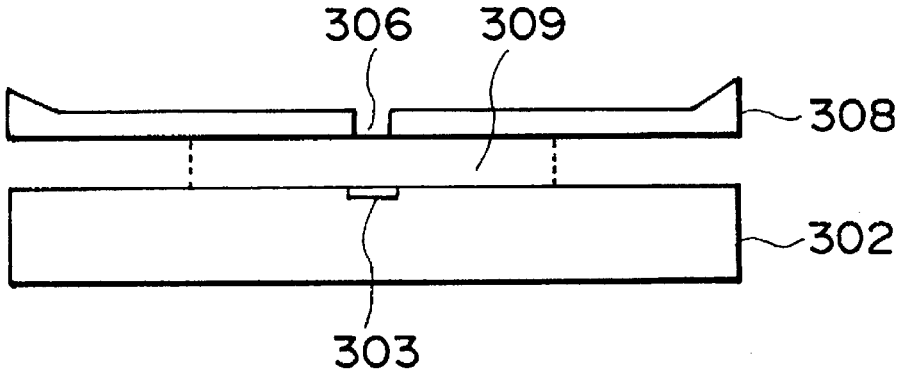

The ink jet recording head has the structure shown in FIG. 15A. FIG. 15B is a sectional view taken along a line A—A in FIG. 15.

In the ink jet recording heads of these embodiments, the ink flowing through the ink passages 309 is heated by ejection energy generating elements 303 (heater), by which the ink droplets are ejected upwardly from ink ejection outlet 306.

The orifice plate 308 was manufactured in the same manner as in Embodiment 24. The ions used are $O^+$ ions, and the hydrophilic treatment was effected with the same condition as with Embodiment 24.

The orifice plate was bonded and secured to the liquid passage wall in such a manner that the ion injected surface is inside and that the ink ejection outlets 306 are aligned with the ink ejection energy generating elements 303.

Embodiment 27

An ink jet recording head was manufactured in the same manner as Embodiment 26 except that the injected ions are $H^+$.

Comparison Example 2

An ink jet recording head was manufactured in the same manner as Embodiment 22 except that the ion injections are not effected.

Comparison Example 3

An ink jet recording head was manufactured in the same manner as with Embodiment 24 with the exception that the ion injection was not effected.

Comparison Example 4

An ink jet recording head was manufactured in the same manner as Embodiment 26 except that the ion injection was not effected.

Ink ejecting tests were performed by the thus manufactured recording heads under the following conditions:

Signal pulses:

Applied pulse width: 10 μsec

Pulse frequency: 10 kHz

Ink:

Water: 70 parts by weight

Diethylene glycol: 26 parts by weight

Direct Black 154: 4 parts by weight

All of the ink jet recording heads according to the embodiments were stably operated to eject the ink with high accuracy of ink droplet shot position over more than $10^9$ pulses. A test was carried out which the ink supplied from the ink supply port deliberately contains fine bubble. However, the ink could be ejected without problem.

With the ink jet recording heads of Comparison Examples, improper ejections were frequently observed. Deposition of fine bubbles on the top wall in the liquid chamber was observed in the case of the recording head of Comparison Example 2. With the recording head of Comparison Example 3, fine bubbles were deposited to the inside of the orifice plate and the inside of the top wall. In Comparison Example 4, fine bubbles are observed as being deposited on the inside of the orifice plate.

As described in the foregoing, at least a part of the ink contacting portion of the ink jet recording head is treated for hydrophilic property by ion injection through the ion injection method, and the back side of the orifice plate made of water repelling material is injected by ions through the ion injection method to obtain the hydrophilic property, and therefore:

1) Stable ejections are possible over a long period of time of ink ejections:

2) Unnecessary bubbles do not stagnate in the ink jet recording head, and therefore there is no need for special means for removing the bubbles. Therefore, it is possible to provide a low cost ink jet recording apparatus:

3) These advantageous effects are particularly remarkable when high speed printing is carried out.

This invention includes any combination of the foregoing embodiments. Therefore, it is possible to combine the ejection outlet formation in the orifice plate by ion machining, the surface treatment of the orifice plate, and the ion injection motor repelling treatment, can be combined.

In addition, the hydrophilic treatment by ion injection to the ink contacting portion of the inside wall of the recording head, may be combined with the water repelling property treatment by ion injection into the ejection side surface.

The surface treatment of the ejection side surface may be combined with the ejection outlet formation by ion machining.

For example, the ink contact portion of the inside wall of the recording head is treated for the hydrophilic property to prevent bubble stagnation and in addition, the ejection side surface may be treated for the water repelling property. Then, the ejection energy loss is low, and the ink ejection direction is stabilized, so that very stable recording is possible.

While the invention has been described with reference to the structures disclosed herein, it is not confined to the details set forth and this application is intended to cover such modifications or changes as may come within the purposes of the improvements or the scope of the following claims.

What is claimed is:

1. A manufacturing method for an ink jet head comprising an ink ejection side surface having an ejection outlet and an energy generating element for generating energy for ejecting an ink, said method comprising the steps of:

providing a base member having said ejection side surface;

forming said ejection outlet in said ejection side surface of said base member; and injecting F-containing ions into said ejection side surface to provide said ejection side surface with a water repelling property.

2. A method according to claim 1, wherein the ions further comprise C.

3. A method according to claim 1, wherein said ejection outlet is formed by ion machining.

4. A method according to claim 1, further comprising a step of injecting into said ejection side surface ions containing at least one of $N^+$ and Si ions or $B^+$ and $N^+$ ions.

5. A method according to claim 1, further comprising a step of injecting into said ejection side surface metal ions to provide the ejection side surface with electroconductivity.

6. A method according to claim 1, wherein an ion accelerating voltage upon the ion injection is 5–100 Kev.

7. A manufacturing method for an ink jet head having an ink ejection side surface having an ejection outlet and an energy generating element for generating energy for ejecting an ink, comprising the steps of:

providing a base member having said ejection side surface;

coating said ejection side surface of said base member with a surface layer;

forming said ejection outlet in said ejection side surface of said base member; and injecting F-containing ions into said surface layer to provide said surface with a water repelling property.

8. A method according to claim 7, wherein the ions further comprise C.

9. A method according to claim 7, wherein said ejection outlet is formed by ion machining.

10. A method according to claim 7, further comprising a step of injecting into said ejection side surface ions containing at least one of $N^+$ and Si ions or $B^+$ and $N^+$ ions.

11. A method according to claim 7, further comprising a step of injecting into said ejection side surface metal ions to provide the ejection side surface with electroconductivity.

12. A method according to claim 7, wherein an ion accelerating voltage upon the ion injection is 5–100 KeV.

13. A manufacturing method for manufacturing an ink jet recording head having an inside surface, comprising the steps of:

preparing an ink passage having an ink ejection energy generating element disposed in said passage;

forming an ink ejection outlet, in communication with said ink passage, through which a droplet of an ink is ejected by actuation of the ink ejection energy generating element onto a recording material;

preparing an ink chamber in fluid communication with said ink ejection outlet through said ink passage; and injecting ions into a part of the inside surface of said ink jet recording head which is in contact with the ink to provide the part with a hydrophilic property, wherein said ions are $O^+$ ions, $H^+$ ions, $Au^+$ ions or a combination thereof.

14. A manufacturing method for an ink jet head having an ink ejection side surface having an ejection outlet, an energy generating element for generating energy for ejecting an ink, and an ink passage in fluid communication with said ejection outlet, comprising the steps of:

providing a base member comprising a material having a water repelling property, and having said ejection side surface;

forming said ejection outlet in said ejection side surface of said base member; and injecting ions into a portion constituting the ink passage to provide the portion with a hydrophilic property, wherein said ions are $O^+$ ions, $H^+$ ions, $Au^+$ ions or a combination thereof.

* * * * *

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

ON TITLE PAGE AT [57] IN THE ABSTRACT

Line 2, "facturing" should read --facturing an--.

COLUMN 1

Line 13, "recording of" should read --recording--;
Line 14, "recording" should read --recording of--;
Line 24, "Jet" should read --jet--;
Line 35, "recording" should read --a recording-- and "the" (second occurrence) should read --a--;
Line 63, "non-uniformly" should read --non-uniform--.

COLUMN 2

Line 2, "instable" should read --unstable--;
Line 3, "quality," should read --quality--;
Line 5, "This" should read --These--.

COLUMN 3

Line 8, "produce, is" should read --produced, are--;
Line 27, "natures" should read --nature--;
Line 43, "removed" should read --removed;--;
Line 58, "to" should be deleted;
Line 66, "impractical" should read --impractically--.

COLUMN 5

Line 25, "ion" should read --an ion--;
Line 29, "a" should be deleted;
Line 42, "ion" should read --an ion--;
Line 66, "manufacturing" should read --the manufacturing--.

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 6

Line 52, "obtained" should read --obtained,--;
Line 53, "machining" should read --the machining--;
Line 54, "the" should be deleted;
Line 56, "current" should read --current is--;
Line 57, "10 pA, should read --100 pA--;
Line 61, "machining," should read --machining--.

COLUMN 7

Line 17, "made" should be deleted and "of" should read --made of --.
Line 31, "the paper" should read --paper--;
Line 49, "$Ta_2n$," should read --$Ta_2N$,--;
Line 57, "method-" should --method.--

COLUMN 8

Line 9, "metal" should read --the surface of a metal--.
Line 26, "So" should read --to--;
Line 32, "and" should be deleted;
Line 35, "hardness" should read --necessary hardness--;
Line 60, "an" should read --and a--.

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 9

Line 4, "above mentioned" should read --above-mentioned--;
Line 5, "100 eV," should read --110 keV,--;
Line 15, "and" should read --an--;
Line 27, "to them" should be deleted;
Line 35, "like" should(insert) --like,--;
Line 36, "the" should be deleted;
Line 37, "pressure," should read --pressure, and--;
Line 46, "given the electric conductivity." should read --made electrically conductive.--;
Line 54, "the" (second occurrence) should be deleted;
Line 61, "hydrophilic" should read --a hydrophilic--.

COLUMN 10

Line 40, "moisture ink" should read --moisture, ink,--;
Line 44, "First," should read --First is--;
Line 67, "evaporation" should read --the evaporation--.

COLUMN 11

Line 6, "thereof," should read --thereof--;
Line 14, "the dose" should read --a dose--;
Line 15, "ion" should read --ions--;
Line 23, "the" should read --an--;
Line 28, "the" should be deleted--;
Line 40, "with the" should read --with an--;
Line 53, "the" should be deleted--;
Line 63, "the" (first occurrence) should be deleted.

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 12

Line 36, "printer" should read --printer,--;
Line 59, "election" should read --ejection--.

COLUMN 13

Line 27, "the" should read --a--;
Line 30, "the" (first occurrence) should be deleted;
Line 50, "to," should read --so,--;
Line 51, "charged" should read --charged,--;
Line 65, "the (second occurrence) should be deleted and "surface" should read --the surface--;
Line 66, "the" should be deleted.

COLUMN 14

Line 5, "By" should read --Because of the--;
Line 6, "the" (first two occurrence) should be deleted;
Line 8, "speed" should read --speed,--;
Line 17, "with" should read --with an--;
Line 18, "the" should be deleted;
Line 37, "Embodiment 10-12" should read --Embodiments 10-12--.

COLUMN 15

Line 10, "the-ejection" should read --the ejection--;
Line 22, "conditions" should read --conditions,--.

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 18

Line 6, "Embodiment 7" should read --Embodiment 17--;
Line 10, "the" should be deleted;
Line 15, "ions $Ga^+$" should read --$Ga^+$ ions-- and "the" should read --an--;
Line 33, "the" (second occurrence) should read --an--;
Line 34, "an" should be deleted
Line 42, "the" (first occurrence) should be deleted;
Line 46, "the" should be deleted;
Line 53, "with" should read --with an--;
Line 55, "conductive $Al^+$ ion are-similarly" should read --conductive, $Al^+$ ions are similarly--;
Line 58, "respect." should read --respects.--;
Line 67, "the" should read --an--.

COLUMN 19

Line 1, "the" should be deleted;
Line 3, "with" should read --with an--;
Line 23, "outlet" should read --outlets--;
Line 39, "17-21," should read --17-21--;
Line 66, "time," should read --times,--.

COLUMN 20

Line 28, "resistance" should read --resistances--;
Line 29, "An" should read --in--;
Line 30, "17-21," should read --17-21--;

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 20

Line 31, "Embodiments 18" should add Embodiments 17, 18--;
Line 45, "The," should read --the--;
Line 48, "the" should be deleted;
Line 49, "the" (second occurrence) should be deleted.

COLUMN 21

Line 2, "reduced" should read --reduced,--;
Line 3, "speed" should read --speed,--;
Line 45, "$SiO_2$" should read --a $SiO_2$--;
Line 53, "and" should read --an--;
Line 56, "end" should read --and--.

COLUMN 22

Line 19, "the" (second occurrence) should read --an--;
Line 26, "that" should be deleted;
Line 33, "However,the" should read --However, the--

COLUMN 23

Line 3, "with" (first occurrence) should be deleted.
Line 25, "bubble" should read --bubbles.--;
Line 59, "motor" should read --water--.

UNITED STATES PATENT AND TRADEMARK OFFICE

CERTIFICATE OF CORRECTION

PATENT NO. : 5,649,359

DATED : July 22, 1997

INVENTOR(S): KEIICHI MURAKAMI ET AL.

It is certified that error appears in the above-identified patent and that said Letters Patent is hereby corrected as shown below:

COLUMN 24

Line 23, "water should read -- water - --.

Line 37, "5-100 Kev." should read --5-100 KeV.--;

Line 50, "water repelling" should read --water-repelling--.

COLUMN 26

Line 5, "water repelling" should read --water-repelling--.

Signed and Sealed this

Thirty-first Day of March, 1998

*Attest:*

*Attesting Officer*

BRUCE LEHMAN

*Commissioner of Patents and Trademarks*